US007853428B2

(12) United States Patent
Usui et al.

(10) Patent No.: US 7,853,428 B2
(45) Date of Patent: Dec. 14, 2010

(54) APPARATUS FOR DISPLAYING FITNESS EXERCISE CONDITION

(75) Inventors: Gou Usui, Hamamatsu (JP); Michihiko Sasaki, Hamamatsu (JP); Yuji Nodera, Sibuya-ku (JP)

(73) Assignee: Yamaha Corporation (JP)

( * ) Notice: Subject to any disclaimer, the term of this patent is extended or adjusted under 35 U.S.C. 154(b) by 381 days.

(21) Appl. No.: 11/972,752

(22) Filed: Jan. 11, 2008

(65) Prior Publication Data

US 2008/0171636 A1 Jul. 17, 2008

(30) Foreign Application Priority Data

Jan. 11, 2007 (JP) ..... 2007-003842
Jan. 11, 2007 (JP) ..... 2007-003843

(51) Int. Cl.
*G01C 22/00* (2006.01)
*A61B 5/24* (2006.01)

(52) U.S. Cl. ..... 702/160; 482/1; 600/300; 600/509; 702/46

(58) Field of Classification Search ..... 702/160, 702/46; 482/7, 8, 57, 148; 600/300, 502, 600/509; 382/128, 131
See application file for complete search history.

(56) References Cited

U.S. PATENT DOCUMENTS 5,615,685 A * 4/1997 Suga ..... 600/300
2004/0171956 A1* 9/2004 Babashan ..... 600/509

FOREIGN PATENT DOCUMENTS

JP 2001-275999 A 10/2001

OTHER PUBLICATIONS

"Omron Health Counter; HJ-710IT", [searched on Sep. 27, 2006], the Internet URL:http://www.healthcare.omron.co.jp/product/hj710it_1.html.
"Omron Health Counter; management software BI-LINC Standard Edition 1.0"; [searched on Sep. 27, 2006] the internet URL:http://www.walking-style.com/info_index/bi-link/_pag_index.php.

* cited by examiner

*Primary Examiner*—John H Le
(74) *Attorney, Agent, or Firm*—Rossi, Kimms & McDowell LLP

(57) ABSTRACT

An apparatus for displaying a fitness exercise condition is provided. A user (that is, an exerciser) of the apparatus inputs personal basic information on the exerciser. When the apparatus is applied to an arm or wrist of the exerciser and the exerciser carries out fitness exercise, a heart rate is measured during the fitness exercise to record it. Load data indicating hardness of the fitness exercise is calculated on the basis of the personal basic information thus inputted and data on the recorded heart rate. A display section is caused to display notice with a color according to a load on the exerciser for each of predetermined time periods on the basis of the calculated load data. The display section may include first and second display sub sections for displaying first and second notice with first and second colors, respectively.

22 Claims, 18 Drawing Sheets

APPARATUS FOR DISPLAYING FITNESS EXERCISE CONDITION

BACKGROUND

The present invention relates to an apparatus for displaying a fitness exercise condition of an exerciser.

Heretofore, jogging or fitness exercise using a fitness exercise machine such as a treadmill is carried out for health enhancement and the like. It is known an apparatus for displaying a fitness exercise condition that causes a display device to display and inform a heart rate, a base signal counted number and the like obtained by such fitness exercise (for example, the following patent document 1).

Further, it is also known one that visually displays information on the number of steps, walking time, a consumption calorie and the like using bar graphs (for example, the following non-patent documents 2 and 3).

[Patent Document 1] Japanese Patent Application Laid-open Publication No. 2001-275999

[Non-patent Document 2] "Omron Health Counter; HJ-710IT", [online], [searched on Sep. 27, 2006], the Internet: <URL:http://www.healthcare.omron.co.jp/product/hj710it_1.html>

[Non-patent Document 3] "Omron Health Counter; management software BI-LINC STANDARD EDITION 1.0", [online], [searched on Sep. 27, 2006], the Internet: <URL: http://www.walking-style.com/info_index/bi-link/bi-link_pag_index.php>

However, in the above patent document 1, since displayed information is mainly provided with characters, visibility thereof is not too good. Further, in the above non-patent documents 2 and 3, although various kinds of information are displayed with bar graphs, it is hard to grasp what value each of items has at a glance, and it is difficult for an exerciser to recognize each of the items unless the exerciser attentively looks at the bar graphs.

In particular, since the exerciser is tired during fitness exercise and immediately after the fitness exercise, it is difficult for the exerciser to recognize the contents of characters or bar graphs when the displayed information is provided with characters or complicated graphs. Thus, there has been a problem that it is difficult for the exerciser to intuitively and quickly grasp a load condition indicating hardness of fitness exercise.

SUMMARY OF THE INVENTION

In view of the foregoing, it is an object of the present invention to provide an apparatus for displaying a fitness exercise condition that allows an exerciser to quickly grasp the latest load condition of the exerciser by fitness exercise by means of intuitive display.

In order to achieve the above-mentioned object, there is provided an apparatus for displaying a fitness exercise condition, the apparatus including: a basic information inputting section that inputs personal basic information on an exerciser; a heart rate data acquiring section that acquires data on a heart rate measured during fitness exercise; a load calculating section that calculates load data indicating hardness of the fitness exercise on the basis of the personal basic information inputted by the basic information inputting section and the data on the heart rate acquired by the heart rate data acquiring section; a display section; and a display controlling section that causes the display section to display notice with a color according to a load on the exerciser for each of predetermined time periods on the basis of the load data calculated by the load calculating section. Thus, by varying the display color in accordance with the load on the exerciser, it is possible to cause the exerciser to quickly grasp the latest load condition by the fitness exercise using intuitive display.

It is preferable that the apparatus further includes: a start switch that instructs measurement to start; a display instructing switch; and a display position determining section that determines a display position of the notice corresponding to each of the predetermined time periods included between a first time point when the start switch is turned on and a second time point when the display instructing switch is turned on, wherein the display controlling section causes the display section to display the notice corresponding to each of the predetermined time periods at the position determined by the display position determining section. Thus, a change in the display color allows the exerciser to intuitively and quickly grasp transition of the load on the exerciser.

It is preferable that the apparatus further includes: a digestion amount data acquiring section that acquires exercise digestion amount data indicating an amount of digested exercise during the fitness exercise, wherein the display controlling section causes the display section to change a size of the notice corresponding to each of the predetermined time periods to be displayed in accordance with the exercise digestion amount data acquired for each of the predetermined time periods by the digestion amount data acquiring section. Thus, a change in the display size allows the exerciser to intuitively and quickly grasp transition of the amount of digested exercise.

It is preferable that the display controlling section causes the display section to display the notice in synchronization with the heart rate. Thus, the exerciser is allowed to grasp the current load on the exerciser using speed and the color of the notice to be displayed.

It is preferable that the display section includes first and second display sub sections, and that the display controlling section causes the first sub display section to display first notice with a first color corresponding to load data for a first predetermined time period calculated by the load calculating section, and causes the second sub display section to display second notice with a second color corresponding to load data for a second predetermined time period that is shorter than the first predetermined time period. Thus, by varying the display color in accordance with the load on the exerciser, it is possible to cause the exerciser to quickly grasp the latest load condition by the fitness exercise using intuitive display. Further, the exerciser is allowed to quickly grasp the latest load condition and the change in the load by means of the display at two kinds of most recent time.

According to another aspect of the present invention, there is provided an apparatus for displaying a fitness exercise condition, the apparatus displaying a load condition of fitness exercise on the basis of load data indicating hardness of the fitness exercise and exercise digestion amount data indicating an amount of digested exercise, the load data and the exercise digestion amount data being measured at predetermined time intervals during the fitness exercise, the apparatus including: a display section for displaying at least notice indicating a fitness exercise load condition with a color for each of the predetermined time intervals; a display controlling section that determines a color with which the notice for each predetermined time interval is to be displayed on the display section on the basis of the load data measured at the predetermined time intervals, and causes the display section to display the notice with the determined color, wherein the apparatus has a form and size adapted to be held on a wrist or arm of an exerciser of the apparatus.

According to still another aspect of the present invention, there is provided an apparatus for displaying a fitness exercise condition on the basis of load data indicating hardness of fitness exercise and exercise digestion amount data indicating an amount of digested exercise, the load data and the exercise digestion amount data being measured at predetermined time intervals during the fitness exercise, the apparatus including: a display section; a display position determining section that determines a display position of an image to be displayed on the display section in correspondence with each of the predetermined time intervals, the image having a predetermined shape; a size determining section that determines a size of the image corresponding to each of the predetermined time intervals on the basis of the exercise digestion amount data measured at the predetermined time intervals; a color determining section that determines a color of the image corresponding to each of the predetermined time intervals on the basis of the load data measured at the predetermined time intervals; and a display controlling section that causes the display section to display the image corresponding to each of the predetermined time intervals at the display position determined by the display position determining section, the image having the size determined by the size determining section and the color determined by the color determining section.

According to yet still another aspect of the present invention, there is provided an apparatus for displaying a fitness exercise condition on the basis of load data indicating hardness of fitness exercise and exercise digestion amount data indicating an amount of digested exercise, the load data and the exercise digestion amount data being measured at predetermined time intervals during the fitness exercise, the apparatus including: a display section; a display arrangement line determining section that determines each of display arrangement lines when an image is to be displayed on the display section in accordance with each of the predetermined time intervals, the image having a predetermined shape corresponding to each of the predetermined time intervals; an on-line position determining section that determines a display position of the image corresponding to each of the predetermined time intervals on the corresponding display arrangement line on the basis of the exercise digestion amount data measured at each of the predetermined time intervals; a size/color determining section that determines at least one of a size and a color of the image corresponding to each of the predetermined time intervals on the basis of the load data measured at each of the predetermined time intervals; and a display controlling section that causes the display section to display the image corresponding to each of the predetermined time intervals at the display position determined by the on-line position determining section on the display arrangement line determined by the display arrangement line determining section, the image having at least one of the size and the color determined by the size/color determining section.

BRIEF DESCRIPTION OF DRAWINGS

The foregoing and other objects, features and advantages of the present invention will become more readily apparent from the following detailed description of preferred embodiments of the present invention that proceeds with reference to the appending drawings, in which.

DETAILED DESCRIPTION

Embodiments of the present invention will now be described with reference to the accompanying drawings.

First Embodiment

Figure 1:
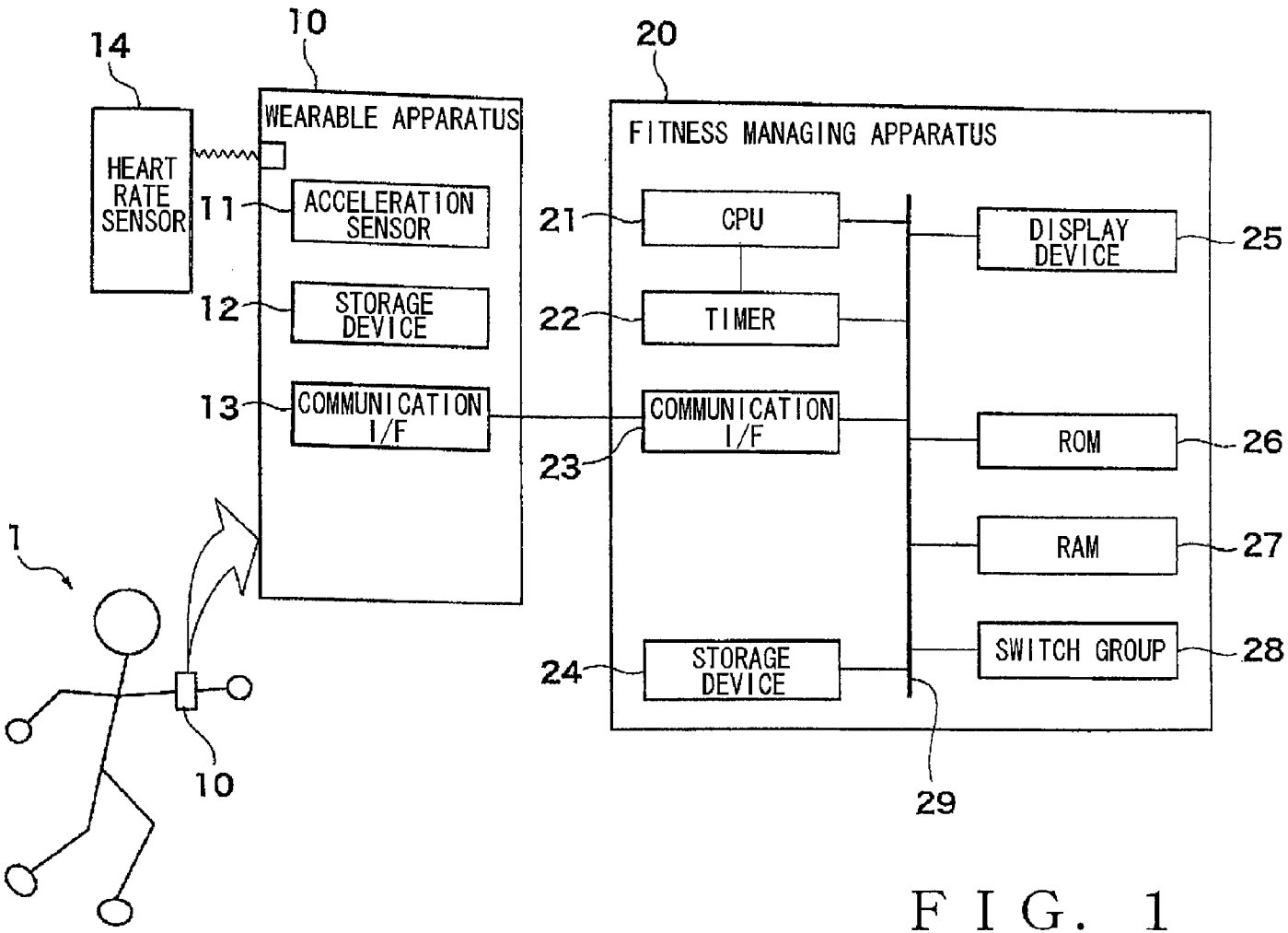
FIG. 1 is a block diagram showing a configuration of a system for displaying a fitness exercise condition, which is configured to include an apparatus for displaying a fitness exercise condition according to a first embodiment of the present invention.

FIG. 1 is a block diagram showing a configuration of a system for displaying a fitness exercise condition, which is configured to include an apparatus for displaying a fitness exercise condition according to a first embodiment of the present invention. This system is constructed from: a wearable apparatus 10 that an exerciser (a user) 1 wears on his or her arm or the like; a heart rate sensor 14 connected to the wearable apparatus 10; and a fitness managing apparatus 20 communicably connected to the wearable apparatus 10. In the present embodiment, the fitness managing apparatus 20 constitutes an apparatus for displaying a fitness exercise condition of the present invention, and the fitness managing apparatus 20 is configured as a personal computer, for example.

The wearable apparatus 10 includes an acceleration sensor 11, a nonvolatile storage device 12 and a communication interface (communication I/F) 13. Further, the external heart rate sensor 14 is attached to the wearable apparatus 10, and a signal from the heart rate sensor 14 is inputted to the wearable apparatus 10. The acceleration sensor 11 detects a walking state of the exerciser 1, whereby the walk count of the exerciser 1 is counted up. The heart rate sensor 14 is attached to an ear lobe or the like of the exerciser 1 to detect pulses of the exerciser 1, and a detected signal is inputted to the wearable apparatus 10. Data on the walk count and the heart rate (bpm: a pulse rate per one minute) respectively acquired by the acceleration sensor 11 and the heart rate sensor 14 are stored in the storage device 12.

The fitness managing apparatus 20 is configured to include a CPU 21, a timer 22, a communication interface (communication I/F) 23, a storage device 24, a display device 25, a ROM 26, a RAM 27 and a group of switches 28, each of which is connected to the CPU 21 via a bus 29.

Both of the communication I/F 13 of the wearable apparatus 10 and the communication I/F 23 of the fitness managing apparatus 20 are general-purpose interfaces such as a Universal Serial Bus (USB) or the like. The wearable apparatus 10 and the fitness managing apparatus 20 are connected to each other via these communication I/Fs so as to be capable of data communication. In this regard, so long as they are connected so as to be capable of data communication, any communication interface may be adopted regardless of wired or wireless.

In the fitness managing apparatus 20, the display device 25 is constructed from a liquid crystal display (LCD) or the like, for example, to display various kinds of information. The CPU 21 controls the whole fitness managing apparatus 20. The ROM 26 stores a control program executed by the CPU 21 and various table data and the like therein. The RAM 27 temporarily stores various kinds of input information, various flags and buffer data, operational results and the like therein. The timer 22 is connected to the CPU 21 to time various time periods such as interrupt time in a timer interrupting process and the like. The storage device 24 is constructed from a hard disk drive or the like to store various application programs including the above control program and various data therein.

Figure 2:
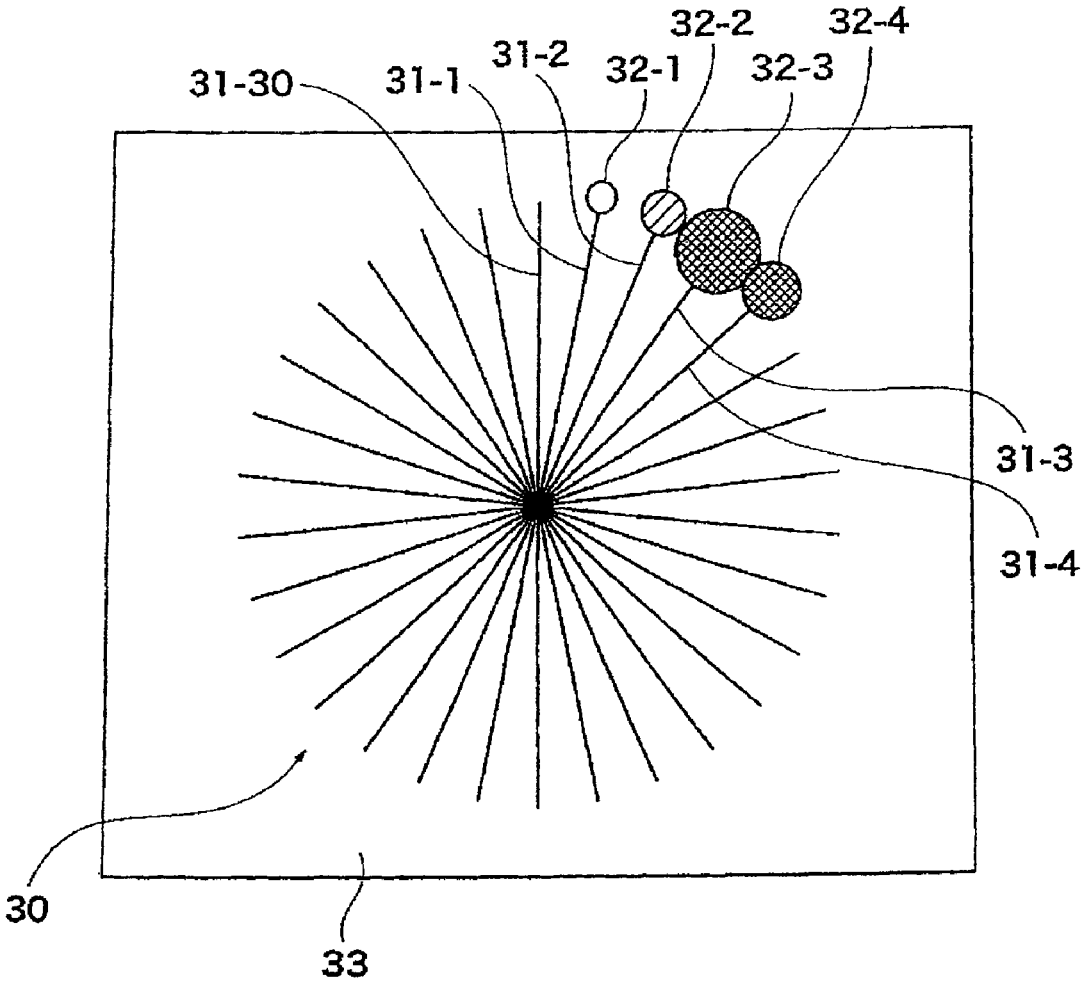
FIG. 2 is a view showing an example of daily display of a fitness exercise condition displayed on a display device.
Figure 3:
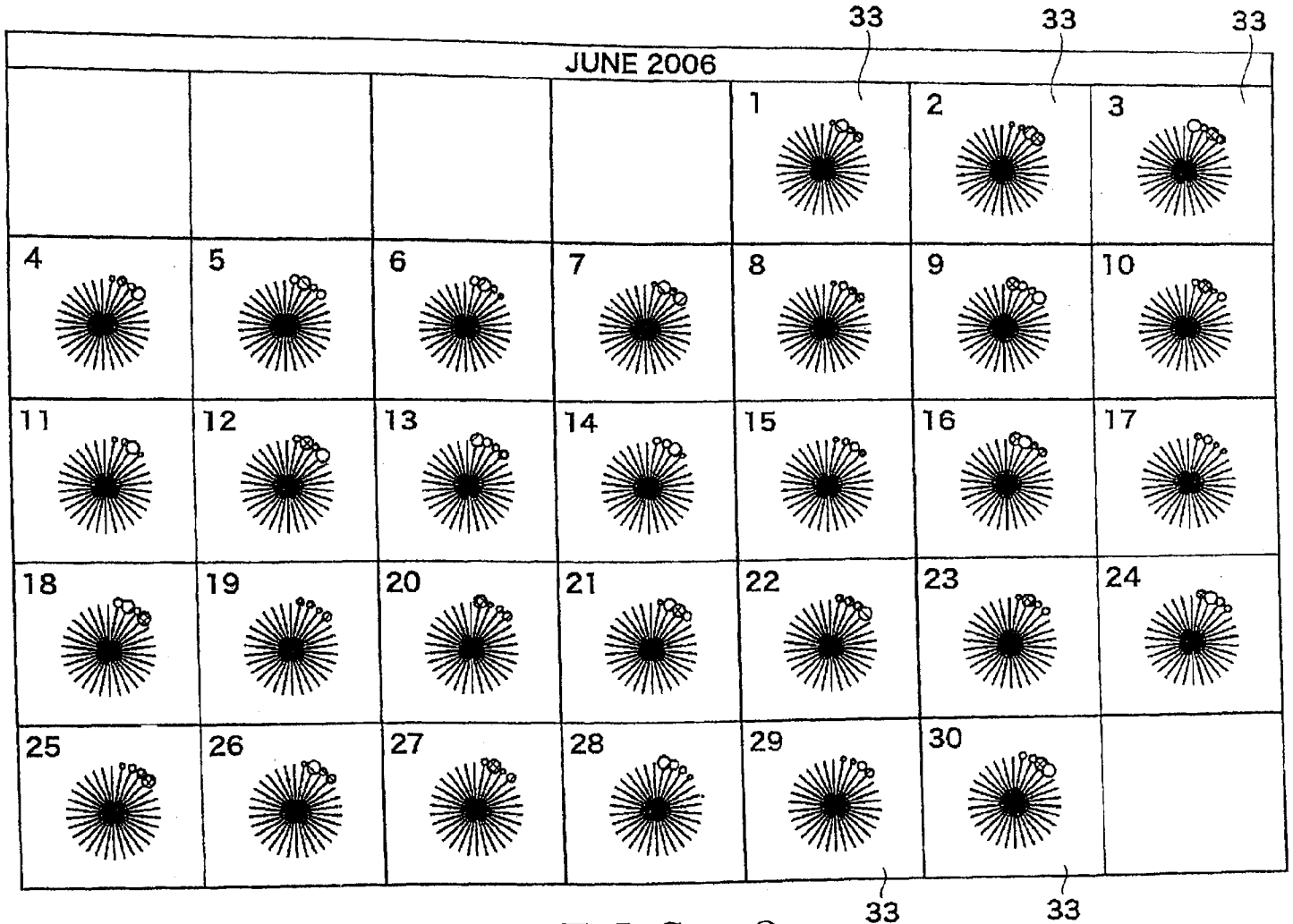
FIG. 3 is a view showing an example of monthly display of a fitness exercise condition displayed on the display device.

FIGS. 2 and 3 are respectively examples of daily display and monthly display of a fitness exercise condition displayed on the display device 25. An outline of the present embodiment will first be described with reference to FIGS. 2 and 3.

The exerciser 1 carries out predetermined fitness exercise (for example, walking using a treadmill) for a fixed time period (for example, 30 minutes or shorter) once every day. At this time, by wearing the wearable apparatus 10 on an arm of the exerciser 1 and attaching the heart rate sensor 14 to his or her ear lobe, data on a heart rate and the number of steps (step number) are stored. At desired time after the fitness exercise, the wearable apparatus 10 is connected to the fitness managing apparatus 20 to transfer the above data to the fitness managing apparatus 20. In the fitness managing apparatus 20, an amount of digested exercise (a walking distance DIST) and load data indicating hardness of the fitness exercise (a percentage of heart rate reserve Hbp: a ratio of a heart rate at measurement to the maximum estimated heart rate reserve value (bpm)) are calculated on the basis of the transferred data. Daily, weekly or monthly display indicating them is then executed in a flower displaying process in response to specification in the display device 25. Hereinafter, display for (exercise for one time)/one day is called "exercise condition flower display 30".

As shown in FIG. 2, in one exercise condition flower display 30, thirty display arrangement lines 31 (31-1, 31-2 . . . 31-30) that extend radially from the center thereof at even intervals are displayed. The thirty display arrangement lines 31 are fixed so as to be displayed in the same manner regardless of data.

However, this is based on the fact that a predefined time period for fitness exercise in one unit (or one lesson) is defined as thirty minutes. The fixed number is not limited to this numeral, and it may be variable.

On the tip of each of the display arrangement lines 31, a circular color ball image 32 (32-1, 32-2 . . . ) is displayed. The number of the color ball images 32 is the same as the number of predetermined time intervals (for example, one minute), which is obtained by dividing duration time of fitness exercise by the predetermined time interval (here, rounding off less than one minute). An angle position of the display arrangement lines 31 indicates elapsed time, and an angle interval corresponds to one minute. For example, in the case where fitness exercise is continued for three minutes, a color ball image 32 is displayed on the tip of each of the display arrangement lines 31-1 to 31-3. Here, a size of the color ball image 32 indicates an amount of digested exercise for the latest one minute, and a color of the color ball image 32 indicates hardness of the fitness exercise (content of exercise) grasped for the latest one minute. The color thereof approaches blue as the fitness exercise does not get harder (Hbp value=0%), and approaches red as the fitness exercise gets harder (Hbp value=100%). In the middle of hardness, the color gets an intermediate color thereof (for example, green or the like) (see FIG. 4B). In other words, when hardness of the fitness exercise (the content of exercise) is appropriate, the color ball image 32 is displayed with green (safety color). This makes it possible for the exerciser 1 to easily view and confirm that the fitness exercise is appropriate.

For example, in the example of FIG. 2, at the time point when one minute elapses from the start of fitness exercise, a size of the color ball image 32-1 is small and a color thereof is blue. Thus, it is possible to visually confirm and understand the condition that the number of steps is not many and the fitness exercise is not hard. Further, since a size of the color ball image 32-3 is large, it can be seen that much fitness exercise is carried out for a time period between two minutes and three minutes from the start of the fitness exercise. Moreover, since the color of the color ball image 32-2 is green and the color of each of the color ball images 32-3 and 32-4 is changed into red, it can be seen that a load on the exerciser 1 becomes greater.

In this example, since the fitness exercise is stopped (or terminated) before five minutes elapses, only four color ball images 32 are displayed. However, for example, when fitness exercise is continued for 30 minutes, 30 color ball images 32 are displayed like a flower. For that reason, the color ball image 32 is called "exercise condition flower display 30". In daily display, one exercise condition flower display 30 for the date specified to be displayed is displayed. A square 33 that is a display area in such a case is the whole area of the display device 25, but it may be a part area fixed on the display device 25.

Further, in monthly display, as shown in FIG. 3, one exercise condition flower display 30 is displayed in each of squares 33. The display area is divided into the squares 33 for all days (for example, 30 days) of the specified month (for example, June, 2006). The number of color ball images 32, a size and a color of each of the color ball images 32 may be different from the respective days in the month. In this regard, although weekly display is not shown in the drawings, one exercise condition flower display 30 may be displayed in each of seven squares 33 for seven days of a specified week.

Figure 4A:
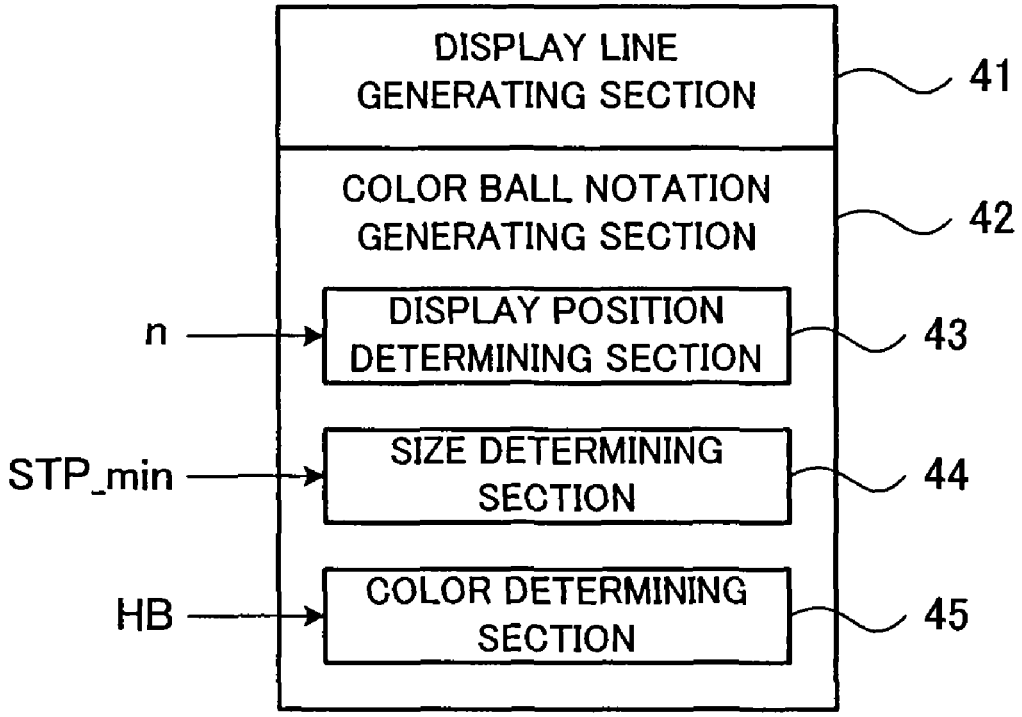
FIG. 4A is a block diagram showing functions relating to exercise condition flower display in a fitness managing apparatus.
Figure 4B:
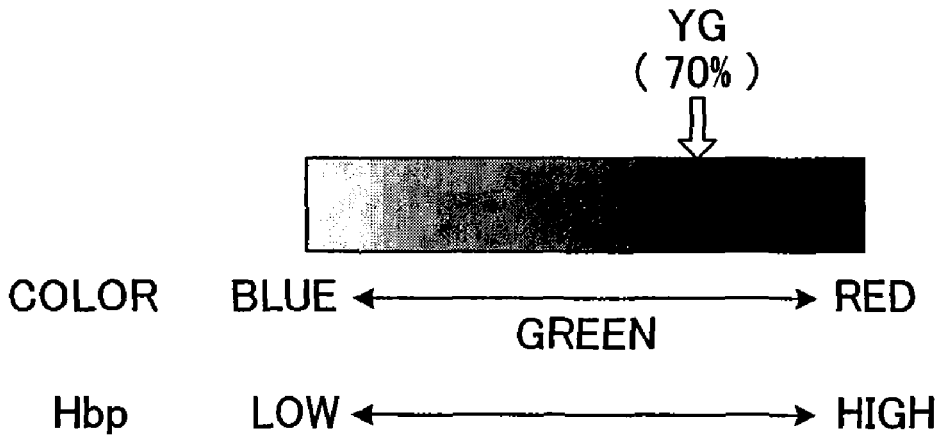
FIG. 4B is a schematic view of an Hbp-color converting table.

FIG. 4A is a block diagram showing functions relating to the exercise condition flower display in the fitness managing apparatus 20. FIG. 4B is a schematic view of an Hbp-color converting table. As shown in FIG. 4A, a functional section of each of a display arrangement line generating section 41 and a color ball notation generating section 42 is provided in the fitness managing apparatus 20. These functions are actually realized and achieved in cooperation with the CPU 21, the timer 22, the storage device 24, the ROM 26, the RAM 27 (see FIG. 1) and the like. The Hbp-color converting table is stored in the ROM 26, for example.

As described above, as shown in FIG. 4B, a display color of a color ball image 32 becomes near blue as the Hbp value approaches 0%, and becomes near red as the Hbp value approaches 100%. The display color becomes an intermediate color between 0 and 100%. For example, in the case where Hbp value=70%, the display color is a color YG (yellow or green-tinged yellow).

The display arrangement line generating section 41 generates the display arrangement lines 31. A display position determining section 43, a size determining section 44 and a color determining section 45 are included in the color ball notation generating section 42. The display position determining section 43 determines a display position of each of the color ball images 32, specifically, on the tip of which display arrangement line 31 each of the color ball images 32 is displayed in accordance with duration time n (min.) of the fitness exercise that is composed of 1-minute units. The size determining section 44 determines a display size of each of the color ball images 32 on the basis of the number of steps (hereinafter, described to "step number STP_min" as data). The color determining section 45 determines a display color of each of the color ball images 32 on the basis of the heart rate HB by referring to the Hbp-color converting table (FIG. 4B).

Figures 5A, 5B, 5C:
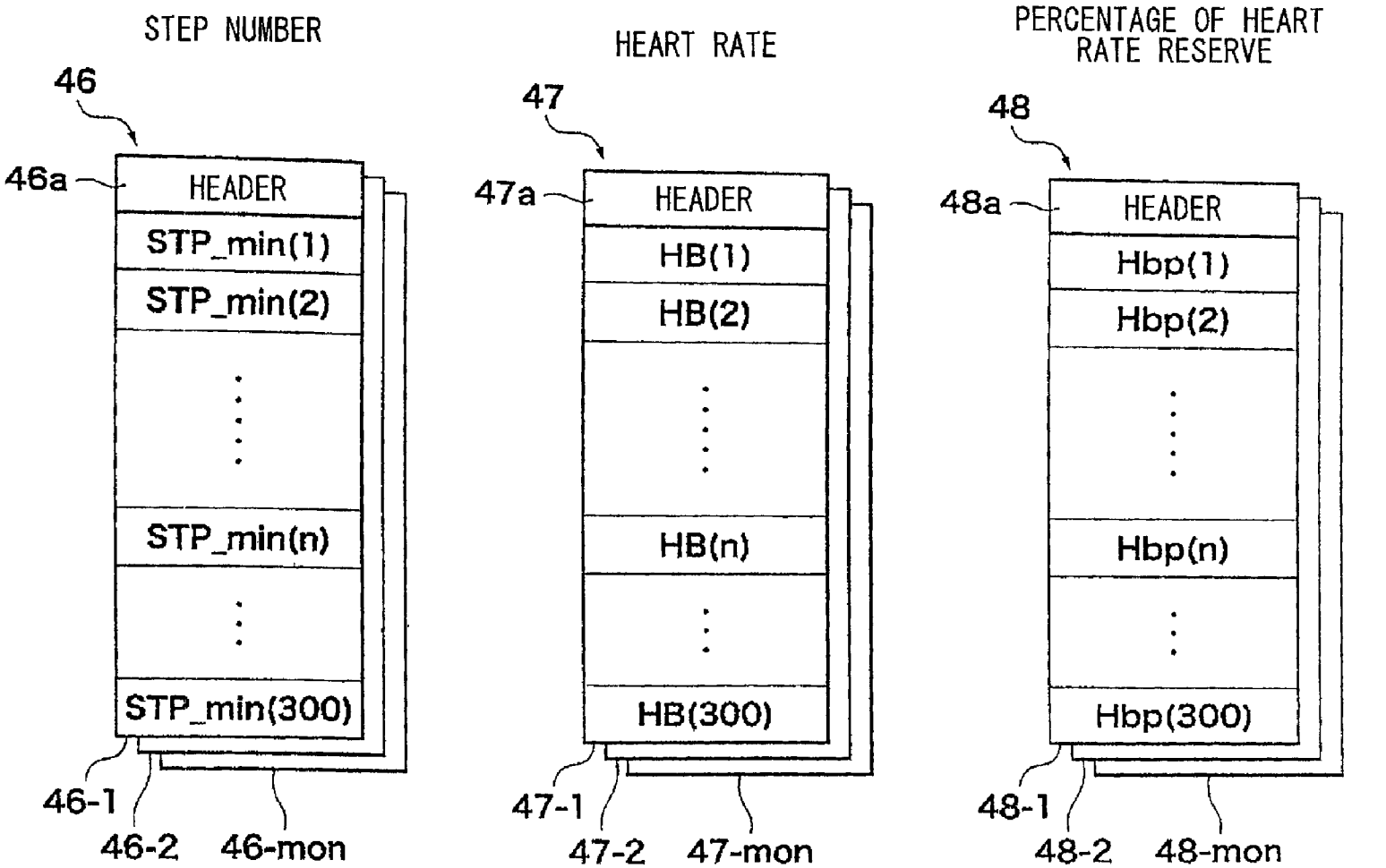
FIGS. 5A to 5C are schematic views each showing data formation of each of kinds of data obtained during the fitness exercise, which is managed by the fitness managing apparatus.

FIGS. 5A to 5C are schematic views each showing data formation of each of kinds of data obtained during the fitness exercise, which is managed by the fitness managing apparatus 20. In each data formation, time by minutes from start of fitness exercise is shown in parentheses. FIG. 5A shows step number data 46, FIG. 5B shows heart rate data 47, and FIG. 5C shows percentage of heart rate reserve (Hbp) data 48. The step number data 46 and the heart rate data 47 are ones in which data detected by the acceleration sensor 11 and the heart rate sensor 14 described above are transferred from the wearable apparatus 10 to be stored in the RAM 27. The Hbp data 48 are ones calculated in a process at Step S204 of FIG. 7 (will be described later).

In the respective data 46 to 48, data for one month are gathered together and these data for one month are respectively provided for a plurality of months. For example, in the step number data 46, step number data 46-1 denotes data on a first day, and data 46-mon denotes data on the final day of the month. In the respective data 46 to 48, headers 46*a*, 47*a* and 48*a* are included in data for one day (for example, data 46-1, 47-1, 48-1), respectively. The headers 46*a*, 47*a* and 48*a* allow the user (exerciser 1) to know (and confirm) the acquired date of the respective data and to recognize correspondent relationship of the data 46 to 48 with reference to day units.

Further, as data formation for one day, data from n−1 minutes to n minutes after the start of the fitness exercise correspond to a step number STP_min(n), a heart rate HB(n), and a percentage of heart rate reserve Hbp(n). For example, as an example of the step number data 46, data for one minute from start of fitness exercise are STP_min(1). Depending on content of conduct (or action), the exerciser 1 may carry out fitness exercise for a long time. Data up to n=300 (5 hours) as a maximum value can be stored as data for one day.

Here, various register values, flags and the like that will appear processes of FIGS. 6 to 8 (will be described later) will now be described.

A "flag F" indicates that data have already been transferred from the wearable apparatus 10 to the fitness managing apparatus 20 after a data transfer instruction as "1". The "flag F" also indicates that the wearable apparatus 10 is disconnected from the fitness managing apparatus 20 as "0".

A "register value mon" defines a target month to be displayed in the flower display, and takes a value of an integer number between 1 and 12.

A "register value D" defines a target day to be displayed in the flower display, and takes a value of an integer number between 1 and 31.

Figure 8:
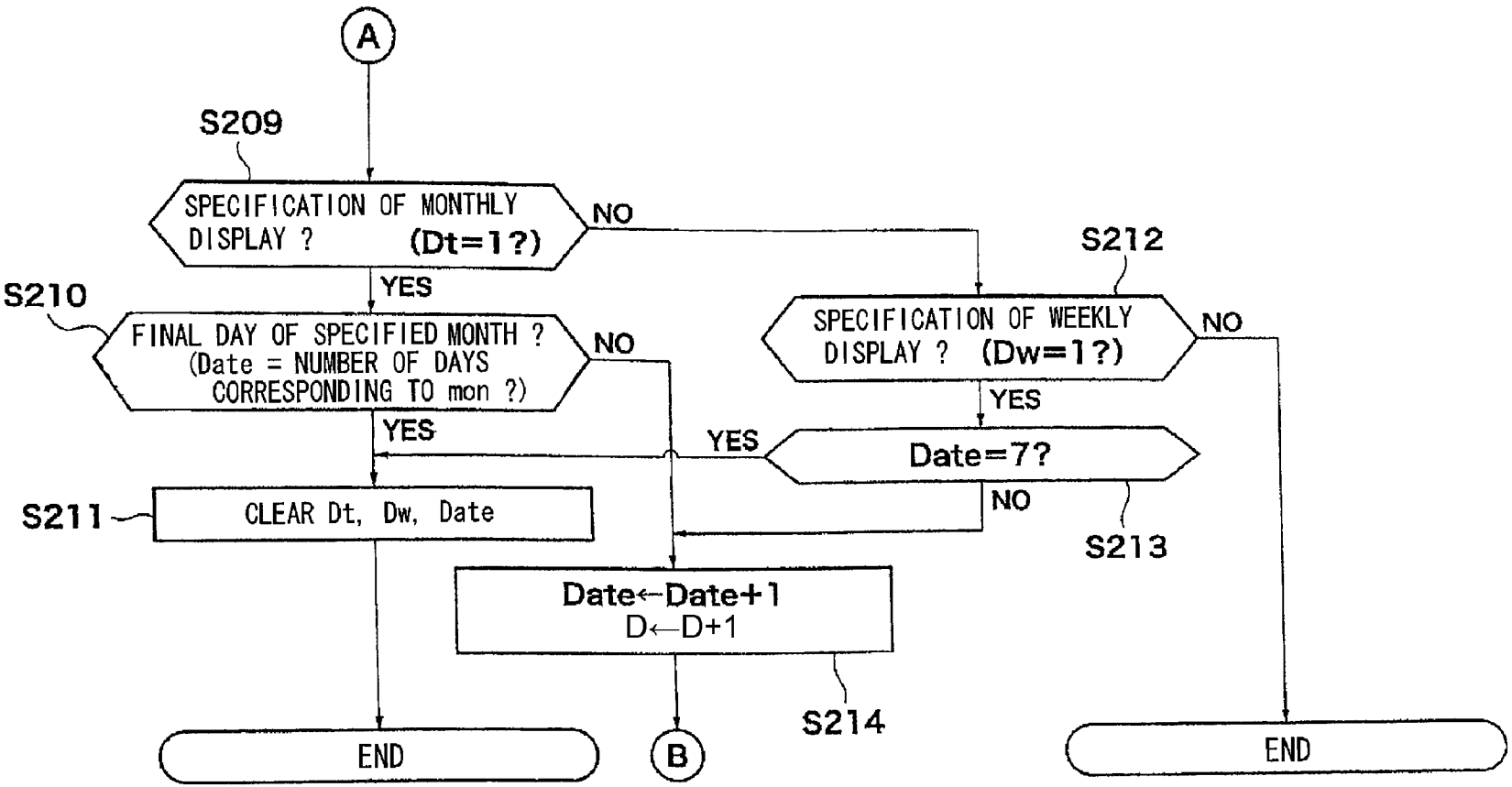
FIG. 8 is a flowchart of the flower displaying process executed at Step S105 of FIG. 6, which is a sequel of the flowchart of FIG. 7.

A "counter value Date" defines a target day to be displayed in the flower display, and is counted up whenever the process at Step S214 of FIG. 8 is executed.

A "flag Dt" defines that monthly display is executed in the flower display as "1" (which takes a value of 0 or 1).

A "flag Dw" defines that weekly display is executed in the flower display as "1" (which takes a value of 0 or 1).

A "stride SPN" is a value indicating a width of one step (meter) of the exerciser 1.

An "age AG" is a value indicating age of the exerciser 1.

A "heart rate at resting period HB_rlx" is a value indicating a heart rate at a resting period of the exerciser 1.

These stride SPN, age AG, and heart rate at resting period HB_rlx are personal basic information in which each of them is different depending on respective persons. In the fitness managing apparatus 20 or the wearable apparatus 10, they are inputted for each exerciser. In the case where they are inputted in the wearable apparatus 10, they are transferred to the fitness managing apparatus 20. In this regard, as the heart rate at resting period HB_rlx, for example, the average value of the heart rates measured before retiring (at bedtime) for 3 days may be adopted, and be sometimes updated.

Further, the following values are used in processes of FIGS. 7 and 8 (will be described later).

Figure 7:
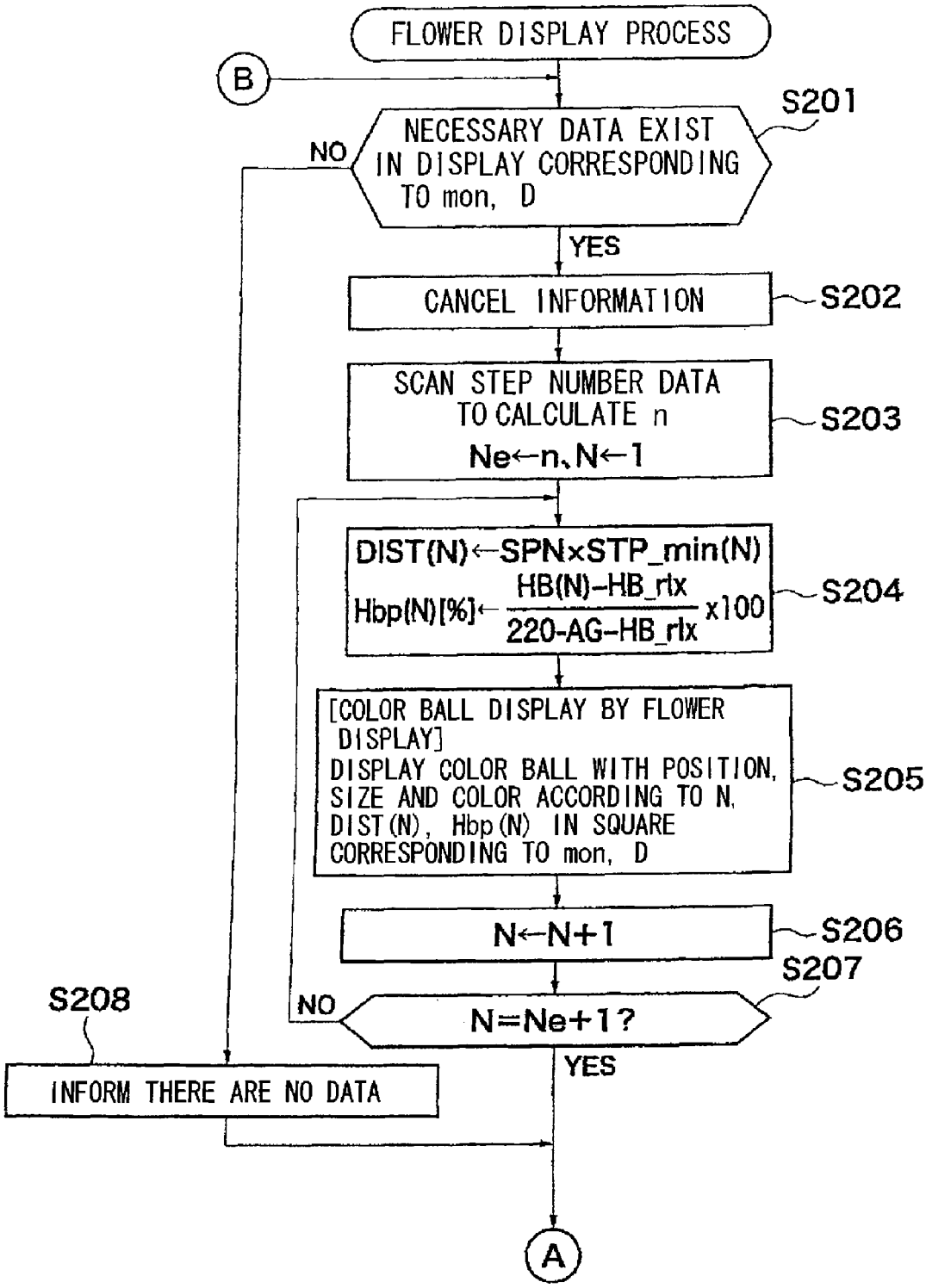
FIG. 7 is a flowchart of a flower displaying process executed at Step S105 of FIG. 6.

A "counter value N" is a value for defining target data and a display position (corresponding display arrangement line 31) of a color ball display at Step S205 of FIG. 7, and is set to "1" at Step S203 and counted up whenever the process at Step S206 is executed.

A "counter value Ne" indicates fitness exercise duration time (min.) at one lesson of fitness exercise, can be varied every time of fitness exercise, and is set to duration time n at Step S203 of FIG. 7.

A "heart rate HB(N)" indicates a heart rate for the latest one minute at N minutes after start of fitness exercise (see FIG. 5).

A "percentage of heart rate reserve Hbp(N)" is calculated at Step S204 of FIG. 7, and indicates hardness of fitness exercise for the latest one minute at N minutes after start of fitness exercise (see FIG. 5). The "percentage of heart rate reserve Hbp(N)" defines a color of a color ball image 32 to be displayed at the tip of the $N^{th}$ display arrangement line 31.

A "walking distance DIST(N)" is calculated at Step S204 of FIG. 7, and indicates a walking distance for the latest one minute after N minutes from start of the fitness exercise. The "walking distance DIST(N)" defines a size of a color ball image 32 to be displayed at the tip of $N^{th}$ display arrangement line 31.

Figure 6:
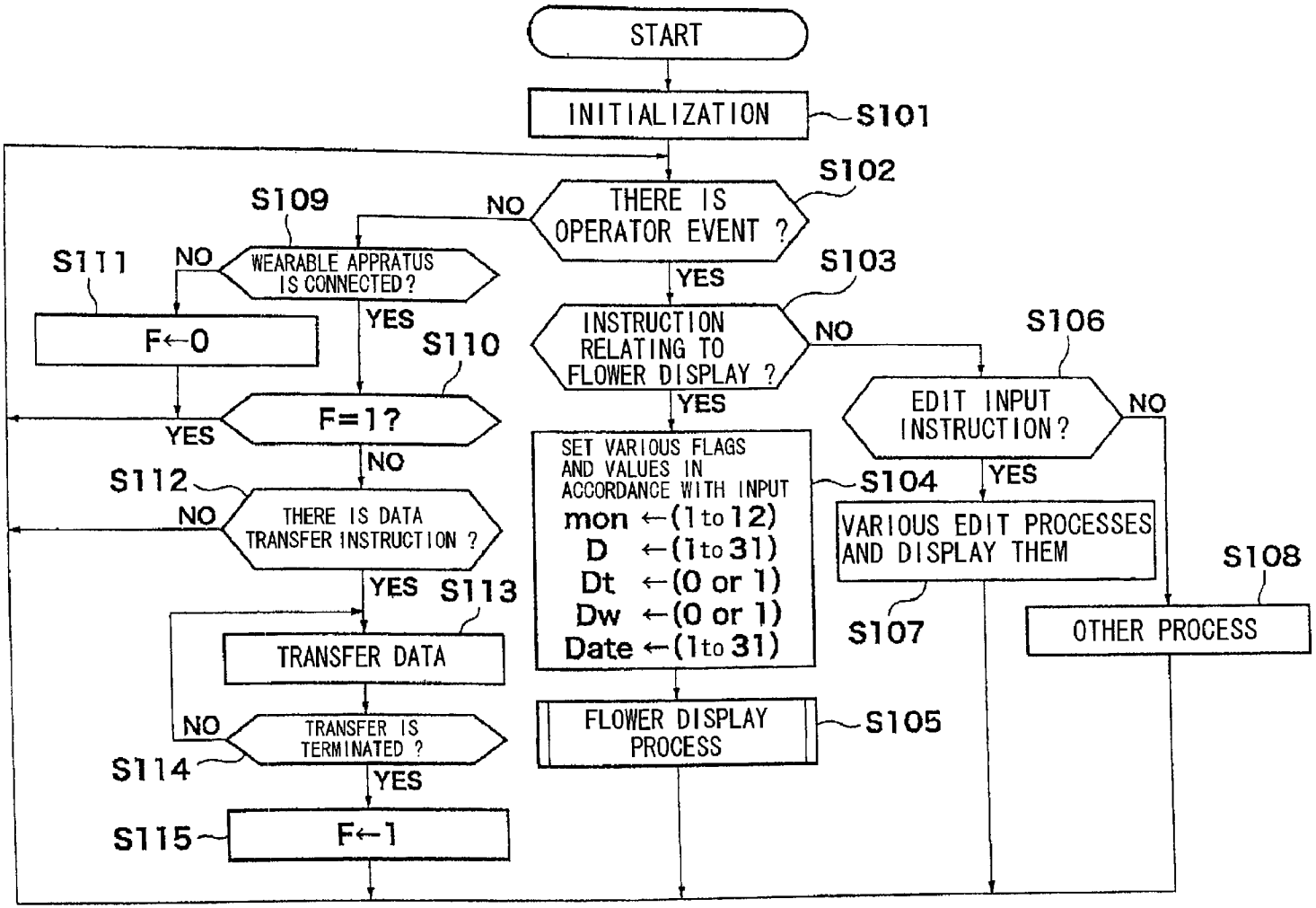
FIG. 6 is a flowchart of a main process executed by the fitness managing apparatus 20.

FIG. 6 is a flowchart of a main process executed by the fitness managing apparatus 20.

Initialization of various flags and register values are first executed (Step S101), and it is determined whether or not there is an operator event other than a data transfer instruction made by an operation of any switch in the group of switches 28 (Step S102). Then, in the case where it is determined that there is no operator event, a process to receive data transfer from the wearable apparatus 10 is executed in accordance with the data transfer instruction (Steps S109 to S115).

Namely, only when an data transfer instruction is made with connection of the wearable apparatus 10 being confirmed and data having not been transferred yet (F≈1) (Steps S109, S110 and S112), a transfer process is executed until transfer of all of the data stored in storage device 12 (see FIG. 1) is terminated (Steps S113 and S114). The flag F is then set to "1" (Step S115), and the processing flow returns to Step S102 described above. When the wearable apparatus 10 is disconnected, the flag F is set to "0" (Steps S109 and S111), and the processing flow returns to Step S102 described above. Here, the data transfer instruction (Step S112) is made by the operation of any switch of the group of switches 28 in the fitness managing apparatus 20.

On the other hand, in the case where there is an operator event other than the data transfer instruction at Step S102, it is determined whether or not the event is an instruction event relating to the flower display (Step S103). As a result of the determination, in the case where it is determined that the operator event is not an instruction event relating to the flower display but an edit input instruction (Step S106), various edit processes and display according to the instruction are executed (Step S107). For example, input of personal basic information such as a stride SPN and an age AG are also carried out at this step.

In this regard, in the case where this personal basic information is inputted into the wearable apparatus 10, the personal basic information is transferred from the wearable apparatus 10 to the fitness managing apparatus 20 in parallel to the data at the data transfer process (Step S113), and is set in the fitness managing apparatus 20. However, even in such a case, the personal basic information that has been set once can be revised and compiled at Steps S106 and S107 in the fitness managing apparatus 20.

Further, in the case where it is determined at Step S106 described above that the instruction is not an edit input instruction but other instruction, "other process" according to the instruction is executed (Step S108), and the processing flow returns to Step S102 described above.

As a result of the determination at Step S103 described above, in the case where it is determined that there is an instruction event relating to the flower display, the processing flow proceeds to Step S104, and various flags and register values are set in accordance with the instruction input. Here, various values are inputted depending on which of monthly, weekly, or daily display a form of the flower display is set to.

For example, in the case of a monthly display instruction, when a desired month is specified, the value (1 to 12) is set in a register value "mon", and the flag and values Dt, D and Date are further set so that Dt=1, D=1 (the first day of the month), Date=1. The flag Dw still remains 0.

Moreover, in the case of a weekly display instruction, when a desired month is specified, the value (1 to 12) is set in the register value "mon". Further, when a target week in the month to be displayed is specified, there are made Dw=1 and Date=1 with the specification, and a value indicating the target first day of the week (Sunday) to be displayed is set in the register value D. The flag Dt still remains 0.

Furthermore, in the case of a daily display instruction, when a desired month is specified, the value (1 to 12) is set in the register value "mon". Further, when a target day in the month to be displayed is specified, the value (1 to 31) is set in the register value D. Moreover, there is made Date=1, and the flags Dt and Dw still remain 0.

Now, the display target is to become a recent one year. Thus, there is no need to specify the year. In this regard, in the case where data before the recent one year can be displayed, a register value for defining a year is also provided in addition to the "mon" value, and the user may be caused to input it.

Next, at Step S105, a flower displaying process of FIG. 7 is executed, and the processing flow returns to Step S102 described above.

In this regard, the "mon" value and the D value can be inputted in the wearable apparatus 10 in advance. In the case where they are inputted in the wearable apparatus 10, the values introduced from the wearable apparatus 10 may be treated as input values in the fitness managing apparatus 20. Even in such a case, the values can be revised in the fitness managing apparatus 20.

FIGS. 7 and 8 are a flowchart of a flower displaying process executed at Step S105 of FIG. 6.

It is first determined whether data necessary for display corresponding to the current mon value and the D value exist or not (Step S201). For example, in the case where monthly display for June is specified, the "mon" value=6 and D value=1 at a first loop. Thus, it is determined whether there are step number data 46-1 and heart rate data 47-1 corresponding to the first day of June (see FIG. 5) or not.

As a result of the determination, in the case where it is determined that the necessary data do not exist, information (or notice) indicating that there are no data (for example, display of a message "there are no data" or display of a blank) is informed by means of audio or screen display (Step S208), and the processing flow then proceeds to Step S209.

On the other hand, in the case where it is determined that necessary data exist, the information indicating that there are no data is canceled (Step S202). At the following Step S203, by scanning the step number data 46 (in the case of the first day, data 46-1) corresponding to the current "mon" value and D value, duration time "n" with one-minute units (the total data of the day) of fitness exercise carried out at the day indicated by the D value is calculated. Then, a "counter value Ne" and a "counter value N" are respectively set to "n" and "1".

Next, at Step S204, a walking distance DIST(N) and a Hbp(N) value are calculated using the following Formulas 1, 2.

$$DIST(N)=SPN\times STP_\min(N) \quad \text{(Formula 1)}$$

$$Hbp(N)\ [\%]=\{HB(N)-HB_rlx\}\times 100/\{220-AG-HB_rlx\} \quad \text{(Formula 2)}$$

Here, "220" in the above Formula 2 is a fixed value.

Next, at Step S205, in the display device 25, squares 33 are laid out in correspondence with the "mon" value, and color ball display for the exercise condition flower display 30 is executed in each of the squares 33 corresponding to the D value. One color ball image 32 is displayed at one process of this step.

To take an instance, when a heart rate HB(N) of a user of the age AG=40 is measured as 142.5 bpm with a heart rate at a resting period HB_rlx55, it becomes Hbp(N) [%]=70%, and the color ball image 32 is displayed with the color YG described above. Incidentally, in the case of this user, when HB(N)=0 computationally, it becomes Hbp(N) [%]=0%. When HB(N)=180, it becomes Hbp(N) [%]=100%.

In the case where the user keeps an exercise condition so as to set Hbp(N) [%]=70% as target hardness and maintain this condition, the user may keep in mind a color YG (see FIG. 4B), and may keep the fitness exercise while sometimes confirming that the color ball image 32 is displayed with the color YG. Since the display color of the color ball image 32 can be viewed intuitively by the user (exerciser 1), the confirmation thereof is easy during the fitness exercise. Further, on the basis that a display color becomes bluish or reddish with respect to the color YG, the exerciser 1 is allowed to intuitively recognize whether the current hardness becomes either less than or more than the target, respectively.

Here, in the case of the monthly display, 30 display arrangement lines 31 are displayed in each of the squares 33 obtained by dividing the display area into the number of days in the month on the display device 25 (see FIG. 3). In the case of the weekly display, 30 display arrangement lines 31 are displayed in each of the divided squares 33 (not shown in the drawings). In the case of the daily display, 30 display arrangement lines 31 are displayed in one square 33. In this regard, even in the case of the daily display, division of the squares 33 may be made in the same manner as that in the case of the monthly display. On the other hand, in the case of the weekly display, the display area of the display device 25 may be divided into seven areas for 7 days.

More specifically, in the square 33 in which the color ball image 32 is to be displayed at this process, the tip position of the display arrangement line 31 corresponding to the N value is defined as a display position of the color ball image 32. For example, in the case of N=1, the color ball image 32-1 is displayed at the tip of the display arrangement line 31-1 in FIG. 2. Further, a size of the color ball image 32 is determined on the basis of the DIST(N) value. The larger the DIST(N) value is, the larger the size of the color ball image 32 becomes. Moreover, a color of the color ball image 32 is determined on the basis of the Hbp(N) value. The larger the Hbp(N) value is, the nearer red the color of the color ball image 32 becomes (see FIG. 4B).

Next, the counter value N is caused to increment (Step S206). Then a determination is made as to whether or not the counter value N is equal to "Ne+1" (Step S207), and the processing flow returns to Step S204 described above if not. Thus, by repeatedly executing the processes at Steps S204 to S207 n times, the color ball images 32 are in turn displayed at the tips of the display arrangement lines 31 in order of the numbers (see FIG. 2). Thus, one exercise condition flower display 30 is displayed in one square 33.

Next, at Step S209 of FIG. 8, it is determined whether specification of the flower display is monthly display specification or not (whether or not the flag Dt=1). In the case where it is determined that the specification is not the monthly display specification, it is determined whether or not the specification is weekly display specification (whether or not the flag Dw=1) (Step S212). In the case of neither monthly nor weekly display specification, the specification is daily display specification. Thus, the processing flow is terminated.

On the other hand, in the case of the monthly display specification at Step S209 described above, it is determined whether or not the present processed target is the final day of the specified month (Step S210). This determination is made by determining whether or not the Date value corresponds with the number of days in the month indicated by the mon value (in the case of June, 30 days). In the case where the Date value corresponds with the number of days, it is determined that the day is the final day.

Then, in the case where the day is not the final day, each of the Date value and the D value is caused to increment (Step S214), and the processing flow returns to Step S201 described above. The processing flow shifts to a display process of exercise condition flower display 30 of the square 33 corresponding to the next day. Further, as a result of the determination at Step S210 described above, in the case of the final day of the specified month, a display process of one month thus specified is completed. Thus, the Dt value, the Dw value and the Date value are cleared (which are respectively set to 0) (Step S211), and the processing flow is terminated.

Further, as a result of the determination at Step S212 described above, in the case where the specification of the flower display is weekly display specification, it is determined whether or not it is the final day of the specified week by determining whether Date=7 is met or not (Step S213). Then, in the case where Date=7 is not met, the process at Step S214 described above is executed, and the processing flow returns to Step S201 described above. The processing flow shifts to a display process of the exercise condition flower display 30 of the square 33 corresponding to the next day. On the other hand, in the case where Date=7 is met, a display process of the specified one week is completed. Thus, the Dt value, the Dw value and the Date value are cleared (Step S211), and the processing flow is terminated.

According to the present embodiment, it is possible to grasp a walking distance in fitness exercise at each time (each instant of time) at one-minute intervals with a display position and a size of each of the color ball images 32 in the exercise condition flower display 30. This makes it possible to grasp hardness of the fitness exercise at each time with the color of each of the color ball images 32. In particular, although the color ball image 32 has single notation, it can give the exerciser 1 an intuitive image of the walking distance and the hardness of the fitness exercise with the size and the color of the color ball image 32 to recognize the walking distance and the hardness of the fitness exercise at a glance. Thus, the exerciser 1 is allowed to quickly grasp a condition of the fitness exercise even at a tired condition immediately after the fitness exercise.

Further, since any one can be selected from three patterns of daily, weekly and monthly display as the display form, the exerciser 1 can be caused to quickly grasp the condition of the fitness exercise that has been carried out multiple times (as multiple lessons) individually for each of the multiple lessons. Therefore, it is useful for management of fitness exercise.

In this regard, in the case where the exerciser 1 carries out two lessons or more of the same fitness exercise a day, data on the first lesson are adopted for the step number data 46 and the heart rate data 47. However, they are not limited to data on the first lesson, and the data may be updated so that the latest ones are adopted. Alternatively, data on all lessons are collected, separate squares are provided for data on a second lesson or later, and the exercise condition flower display 30 may be executed for the data on the second lesson or later.

In this regard, in the present embodiment, in the case where the exerciser 1 carries out fitness exercise over time for one lesson (for example, 30 minutes) of the fitness exercise, the present invention is configured so that data on excess amount are not collected or ignored. However, the present invention is not limited thereto. In the case where the time of fitness exercise exceeds one lesson time, the number of display arrangement lines 31 in one exercise condition flower display 30 may be increased in accordance with excess time, and the color ball images 32 may be densely displayed. In order to do so, the functional block is configured as shown in FIG. 9A.

Figure 9A:
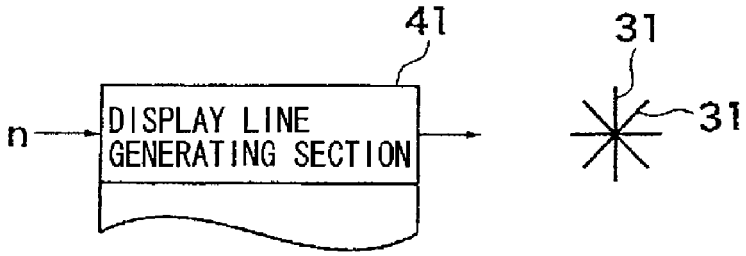
FIG. 9A is a view showing an alternative example of a functional block of the present embodiment.

Namely, as shown in FIG. 9A, the display arrangement line generating section 41 (see FIG. 4A) may generate $n^{th}$ display arrangement lines 31 in accordance with the duration time n.

Figure 9B:
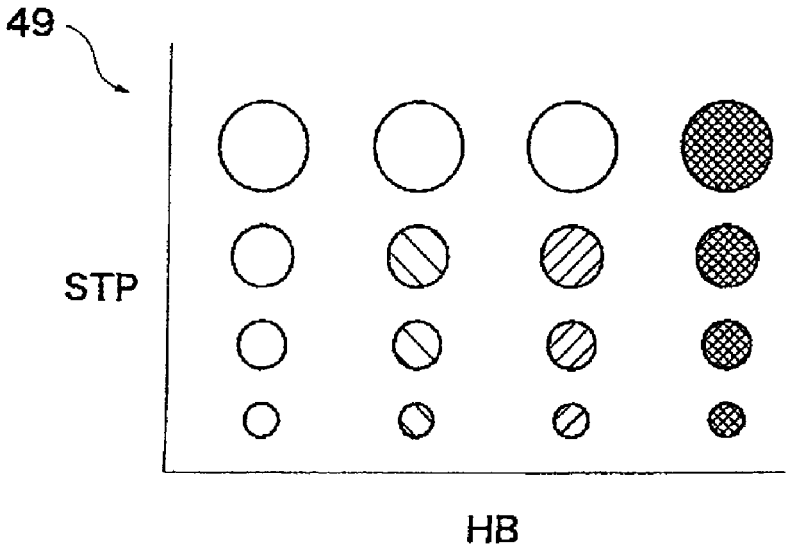
FIG. 9B is a view showing an HB-STP table.

In this regard, in the present embodiment, in order to determine the size and the color of the color ball image 32, the walking distance DIST(N) and the Hbp(N) value are calculated (Step S204 of FIG. 7), but the present invention is not limited thereto. For example, an HB-STP table as shown in FIG. 9B is to be stored. In this table, data for displaying the color ball images 32 each having a different combination of the size and the color are stored in accordance with the STP_min(N) and the heart rate HB(N). The color ball image 32 according to the heart rate HB(N) and the STP_min(N) may be determined by referring to this table.

Figure 9C:
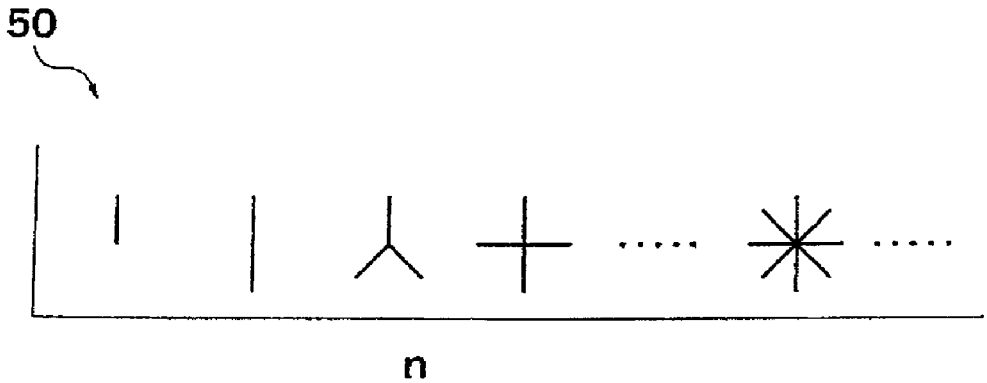
FIG. 9C is a view showing a table for the number of display arrangement lines.

In this regard, in the present embodiment, although all of the display arrangement lines 31 of the fixed number are displayed, only display arrangement lines 31 of the necessary number may be displayed at angular intervals according to the number of display arrangement lines 31. For example, as shown in FIG. 9C, a table for the number of display arrangement lines may be provided in which the number of display arrangement lines 31 becomes larger in accordance with the n value, and display arrangement lines 31 of the number according to the n value may be generated and displayed.

Figure 10A:
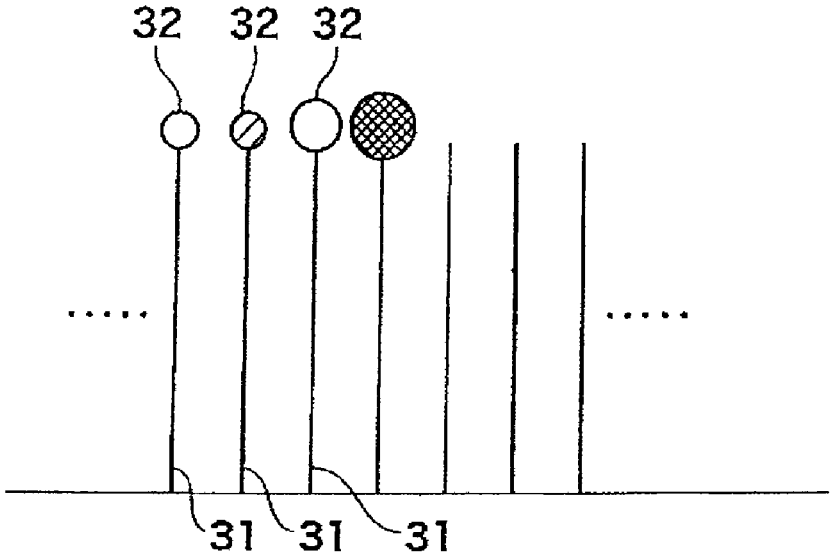
FIGS. 10A and 10B are views respectively showing alternative examples of exercise condition flower display.

In this regard, in the present embodiment, the exercise condition flower display 30 is one in which the display arrangement lines 31 are radially arranged and the color ball images 32 are displayed at the respective tips of the display arrangement lines 31. However, the present invention is not limited thereto. For example, as shown in FIG. 10A, the display arrangement lines 31 may be displayed as bars that are arranged in parallel at even intervals and the color ball images 32 may be displayed at the respective tips of the display arrangement lines 31.

Further, in the color ball image 32, the size and the color may be notated separately. For example, as shown in FIG. 10B, size images 32*a* in which only a size thereof is variable and a color thereof is the same may be displayed at the tip positions of the respective display arrangement lines 31, and color images 32*b* in which a size and a shape thereof is the same and a color thereof is variable may respectively be arranged in the vicinity of the corresponding size images 32*a*, for example, arranged closely outside the corresponding size images 32*a* when viewed from the center for radiation.

Figure 10B:
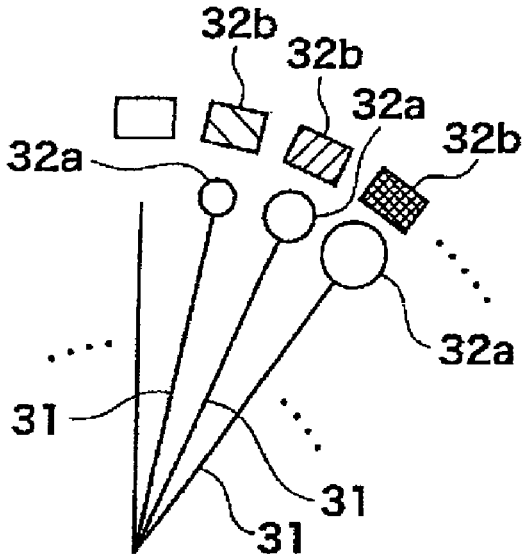

In this regard, in the present embodiment or an alternative example shown in FIG. 10B, shapes of the size image 32*a* and the color image 32*b* are not limited to the circular and rectangular shapes, respectively, so long as the size image 32*a* and the corresponding color image 32*b* are indicated by a single aggregated notation and the size images 32*a* and the color images 32*b* have common shape, respectively.

Second Embodiment

In the first embodiment, the length of the display arrangement line 31 is a fixed value. Thus, the display position of each of the color ball images 32 on the corresponding display arrangement line 31 is fixed. However, in a second embodiment of the present invention, a length of a display arrangement line 31 and a display position of a color ball image 32 are determined in accordance with a walking distance DIST(N).

Figure 11:
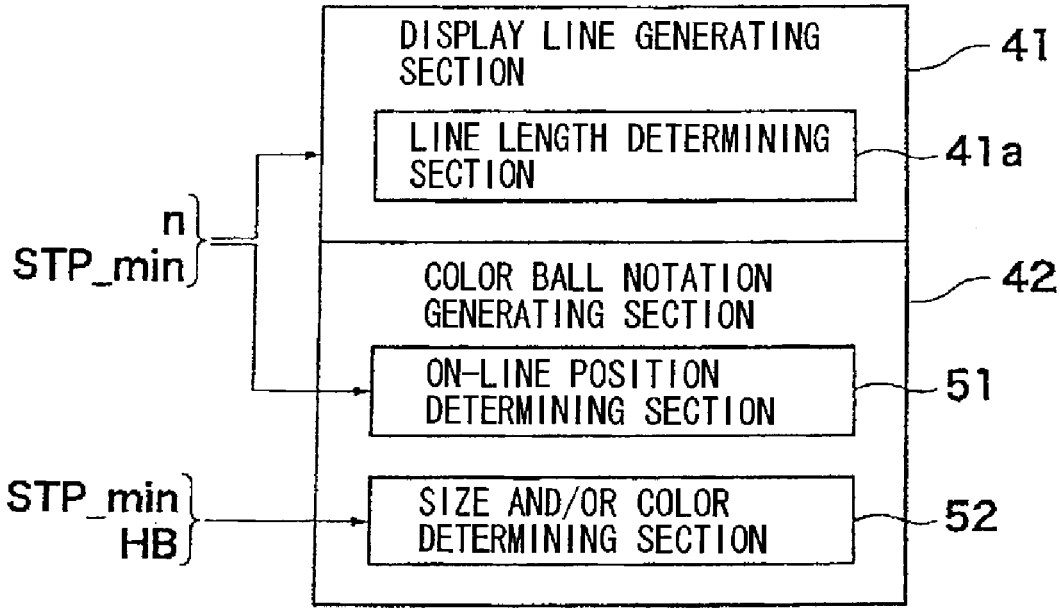
FIG. 11 is a block diagram showing functions relating to the exercise condition flower display in an apparatus for displaying a fitness exercise condition according to a second embodiment of the present invention.

FIG. 11 is a block diagram showing functions relating to the exercise condition flower display in an apparatus for displaying a fitness exercise condition according to a second embodiment of the present invention. In the present embodiment, a functional block relating to exercise condition flower display of the fitness managing apparatus 20 is different from that in the first embodiment, whereby the configuration shown in FIG. 11 is used in place of the configuration shown in FIG. 4A. In addition, the contents of the color ball displaying process executed at Step S205 of FIG. 7 are different from that in the first embodiment together with the configuration of the functional block. Other configuration is however similar to that in the first embodiment.

Figure 12A:
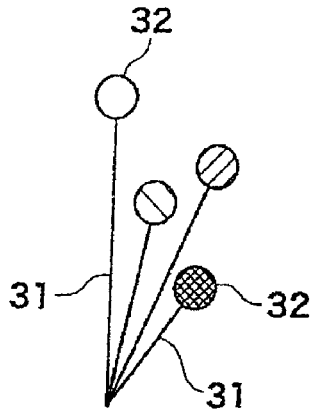
FIGS. 12A to 12D are display examples of the exercise condition of the present embodiment, which correspond to the exercise condition flower display.
Figure 12C:
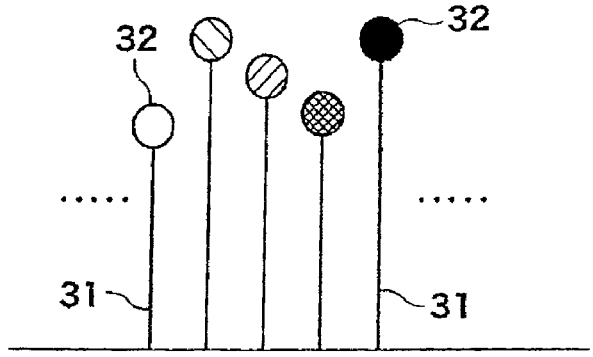
Figure 12B:
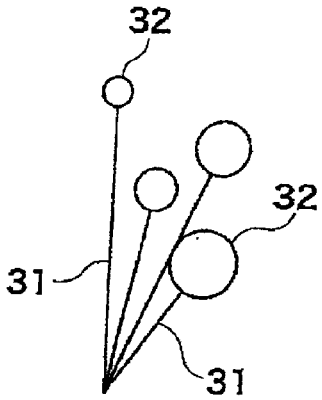

FIGS. 12A to 12D are display examples of the exercise condition of the present embodiment, which correspond to the exercise condition flower display 30. In FIGS. 12A and 12B, display arrangement lines 31 each having a length according to a walking distance DIST(N) (see Step S204 of FIG. 7) calculated using the above Formula 1 on the basis of the step number STP_min(N) are displayed. FIG. 12A also shows a display example in which only a color of each of color ball images 32 is varied in accordance with an Hbp(N) value (see Step S204 of FIG. 7) calculated using the above Formula 2 on the basis of the heart rate HB(N). FIG. 12B also shows a display example in which only a size of each of color ball images 32 is varied in accordance with an Hbp(N) value.

In the present embodiment, as shown in FIG. 11, a line length determining section 41*a* is included in the display arrangement line generating section 41. An on-line position determining section 51 and a size and/or color determining section 52 are included in the color ball notation generating section 42. The display arrangement line generating section 41 generates display arrangement lines 31 in accordance with duration time n (min.) with 1-minute units of fitness exercise. At that time, the line length determining section 41*a* determines a length of each of the display arrangement lines 31 in accordance with the step number STP_min.

The on-line position determining section 51 determines a display position of each of the display arrangement lines 31 and a display position of each of color ball images 32 on the corresponding extended line in accordance with the duration time n and the step number STP_min. More specifically, in the process corresponding to that at Step S205 of FIG. 7, the position corresponding to a DIST(N) value on a virtual straight line including the display arrangement line 31 corresponding to an N value is determined as the display position, and the determined position corresponds with the tip position of each of the display arrangement lines 31 in the present embodiment.

Further, in the present embodiment, the size and/or color determining section 52 determines a color or size of each of the color ball images 32 in accordance with the step number STP_min and the heart rate HB. Here, in the case where the display example of FIG. 12A is adopted, the color of each of the color ball images 32 is determined. In the case where the display example of FIG. 12B is adopted, the size of each of the color ball images 32 is determined. In this regard, both of the color and the size may be determined and the both may be reflected to the display form.

Figure 12D:
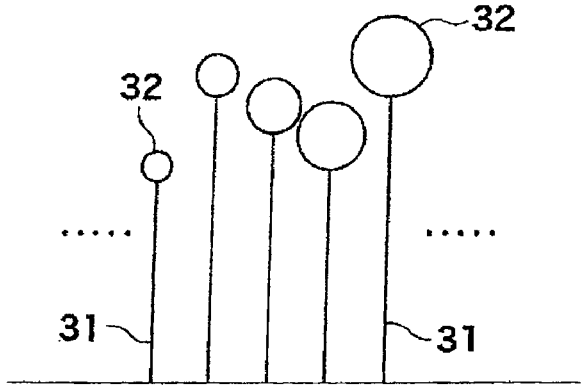

In this regard, in the present embodiment, the exercise condition flower display 30 is not also limited to the radially display in the similar manner to that in the first embodiment. Thus, as shown in FIGS. 12C and 12D, the display arrangement lines 31 may be displayed as parallel bars.

According to the present embodiment, it is possible to achieve the effect similar to that of the first embodiment.

In this regard, in the first and second embodiments, the display arrangement lines 31 may not be displayed actually. In particular, in the case where the display arrangement lines 31 are not displayed in the second embodiment, the display arrangement lines 31 may be treated as virtual straight lines only for being used on operations in order to determine a display position of each of the color ball images 32. Further, at that time, the display arrangement lines 31 may be treated as the virtual straight lines each having an infinite length. In such a case, there is no need to determine the length of each of the display arrangement lines 31.

Third Embodiment

In the first and second embodiments, it is constructed so that data measurement is carried out in the wearable apparatus 10, the measured data are transferred to the fitness managing apparatus 20, and the exercise condition flower display 30 is displayed in the fitness managing apparatus 20. On the other hand, in a third embodiment of the present invention, a display control and a display function of the exercise condition flower display 30 are installed in the wearable apparatus 10. The fitness managing apparatus 20 is not always used, and the exercise condition flower display 30 corresponding to this lesson of fitness exercise is configured to be capable of being displayed only in the wearable apparatus 10.

Figure 13:
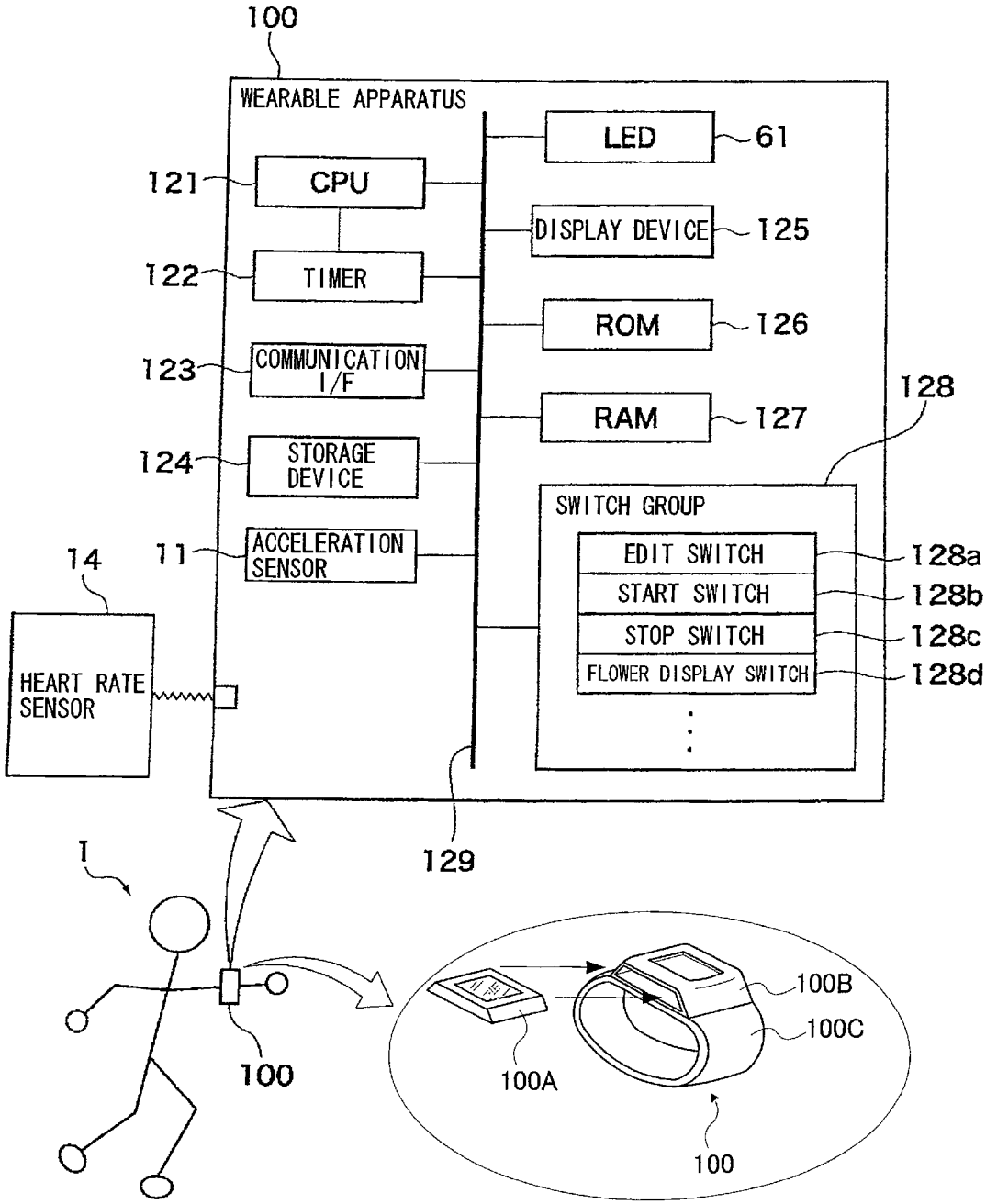
FIG. 13 is a block diagram showing a configuration of an apparatus for displaying a fitness exercise condition according to a third embodiment of the present invention.

FIG. 13 is a block diagram showing a configuration of an apparatus for displaying a fitness exercise condition according to a third embodiment of the present invention. A wearable apparatus 100 having a shape and a size suitable to be worn on a wrist, an arm or the like of the exerciser 1 constitutes an apparatus for displaying a fitness exercise condition according to the present invention.

As shown in FIG. 13, the wearable apparatus 100 is configured to include a CPU 121, a timer 122, a communication interface (communication I/F) 123, a storage device 124, an acceleration sensor 11, an LED 61, a display device 125, a ROM 126, a RAM 127 and a group of switches 128, each of which is connected to the CPU 121 via a bus 129.

The timer 122, the communication I/F 123, the display device 125, the ROM 126, and the RAM 127 are respectively configured in the similar manner to the timer 22, the communication I/F 23, the display device 25, the ROM 26, and RAM 27 in the first embodiment. The configuration of the acceleration sensor 11 and the configuration of the heart rate sensor 14 connected to the wearable apparatus 100 are the same as those in the first embodiment, respectively. The storage device 124 is constructed from a nonvolatile memory or the like. An edit switch (SW) 128*a*, a start switch (SW) 128*b*, a stop switch (SW) 128*c* and a flower display switch (SW) 128*d* are included in the group of switches 128.

In FIG. 13, as appearance of the wearable apparatus 100 is shown so as to be enlarged, each component of the wearable apparatus 100 is placed in a body case 100A. The body case 100A is constructed so as to be suitable to be detachably held in a case holder 100B. A holding assembly 100C (for example, a band) suitable to be worn on a wrist or an arm of the exerciser 1 is provided so as to be attached to the case holder 100B. By attaching the holding assembly 100C to a wrist or an arm of the user while the body case 100A is held in the case holder 100B, the exerciser 1 is allowed to wear the wearable apparatus 100 on the wrist or arm.

Figure 14:
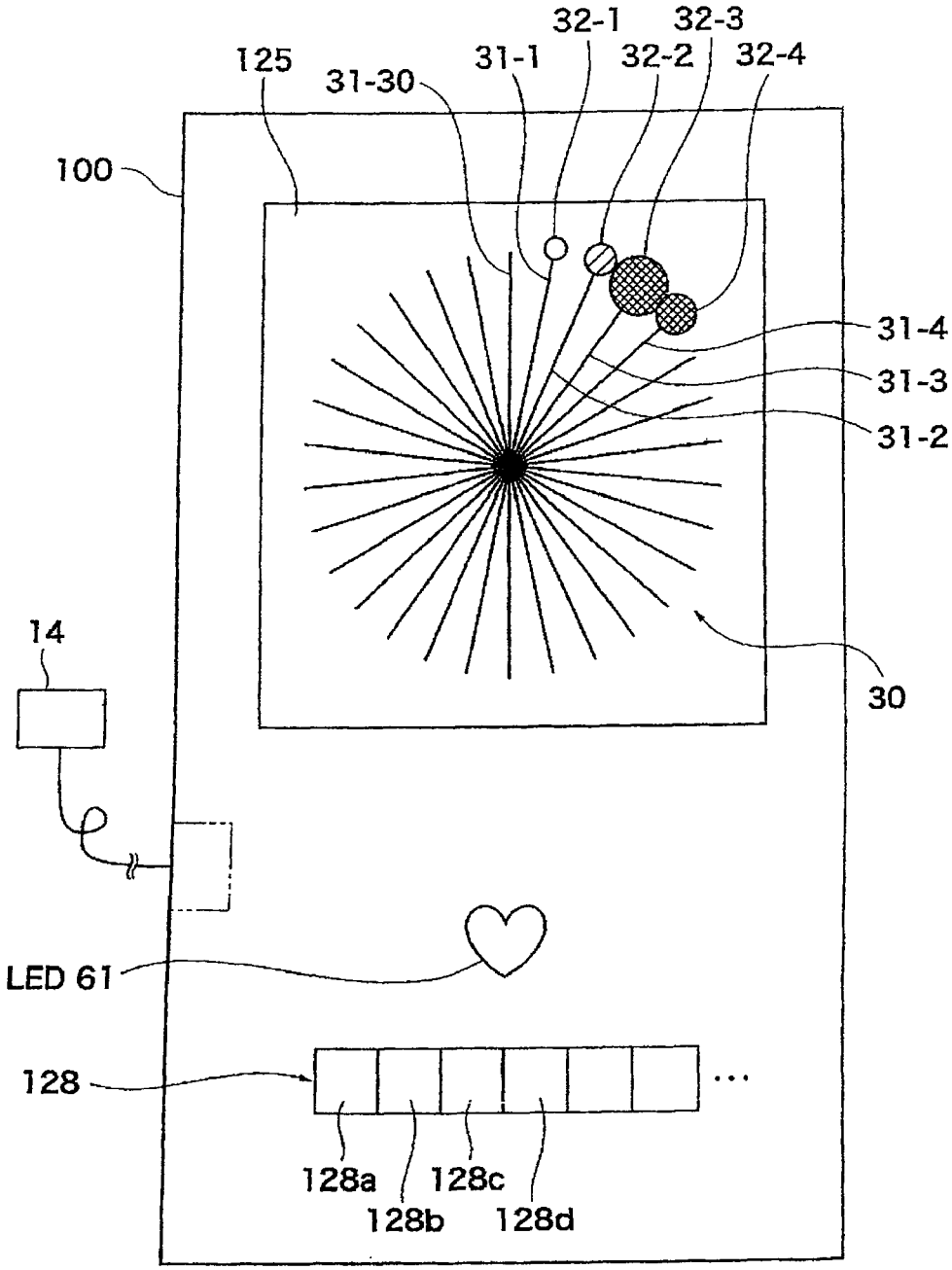
FIG. 14 is a front view of a wearable apparatus.

FIG. 14 is a front view of the wearable apparatus 100. On a front surface of the wearable apparatus 100, the display device 125, the LED 61 and the group of switches 128 are provided. The LED 61 is a multicolor LED that can emit light with each of a plurality of colors.

An outline of the present embodiment will first be described with reference to FIG. 14.

The third embodiment is similar to the first embodiment until the exerciser 1 carries out fitness exercise one lesson a day, and data on the heart rate and the number of steps are stored. In the wearable apparatus 100, the amount of digested exercise (the walking distance DIST) and hardness (the Hbp value) of fitness exercise (contents of the fitness exercise) are calculated on the basis of the acquired data. On the basis of these data, the exercise condition flower display 30 is displayed on the display device 125. On the basis of the Hbp value, the LED 61 is controlled to be turned on only for 0.2 seconds (hereinafter, referred to as "blink display"). In the present embodiment, luminous display by the LED 61 and display of the exercise condition flower display 30 by the display device 125 correspond to "notice display" for indicating a load on the exerciser 1 with a color.

Namely, the LED 61 is turned on or off in synchronization with the detected heart beat during fitness exercise. At that state, the LED 61 emits light with a color according to the heart rate in one minute just past (that is, latest one minute). Further, during one lesson of fitness exercise or after termination of fitness exercise, when the exerciser 1 presses the flower display SW 128*d*, the display arrangement lines 31 and the color ball images 32 corresponding to the respective predetermined time periods until that time point are displayed just for three seconds. A display form of one exercise condition flower display 30 is similar to that in the first embodiment. The size and color of each of the color ball images 32 indicate the amount of digested exercise and hardness of the fitness exercise for the latest one minute, respectively.

Here, various register values, flags and the like that will appear processes of FIGS. 15 to 17 (will be described later) will now be described.

A "flag RUN" is a flag indicating that data measurement is being carried out during fitness exercise as "1".

A "register value HBs" is an integrated value of the heart rate, and is reset every one minute.

A "register value STP" is an integrated value of the step number, and is reset every one minute.

Figure 17:
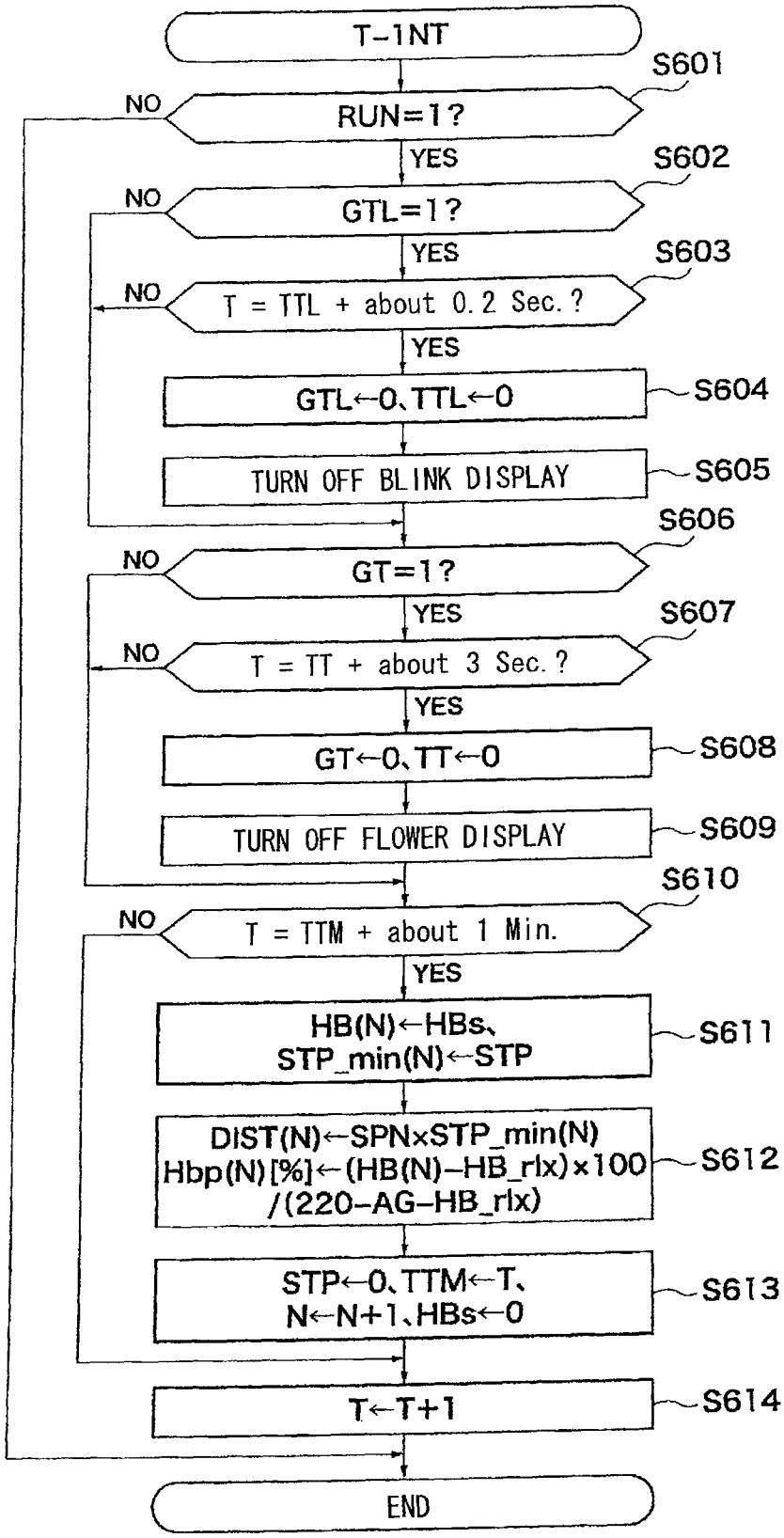
FIG. 17 is a flowchart of a timer process that is executed at fixed time intervals during execution of the main process of FIG. 15.

A "timer T" is a timer indicating current time, and is counted up whenever a process at Step S614 of FIG. 17 is executed.

Figure 15:
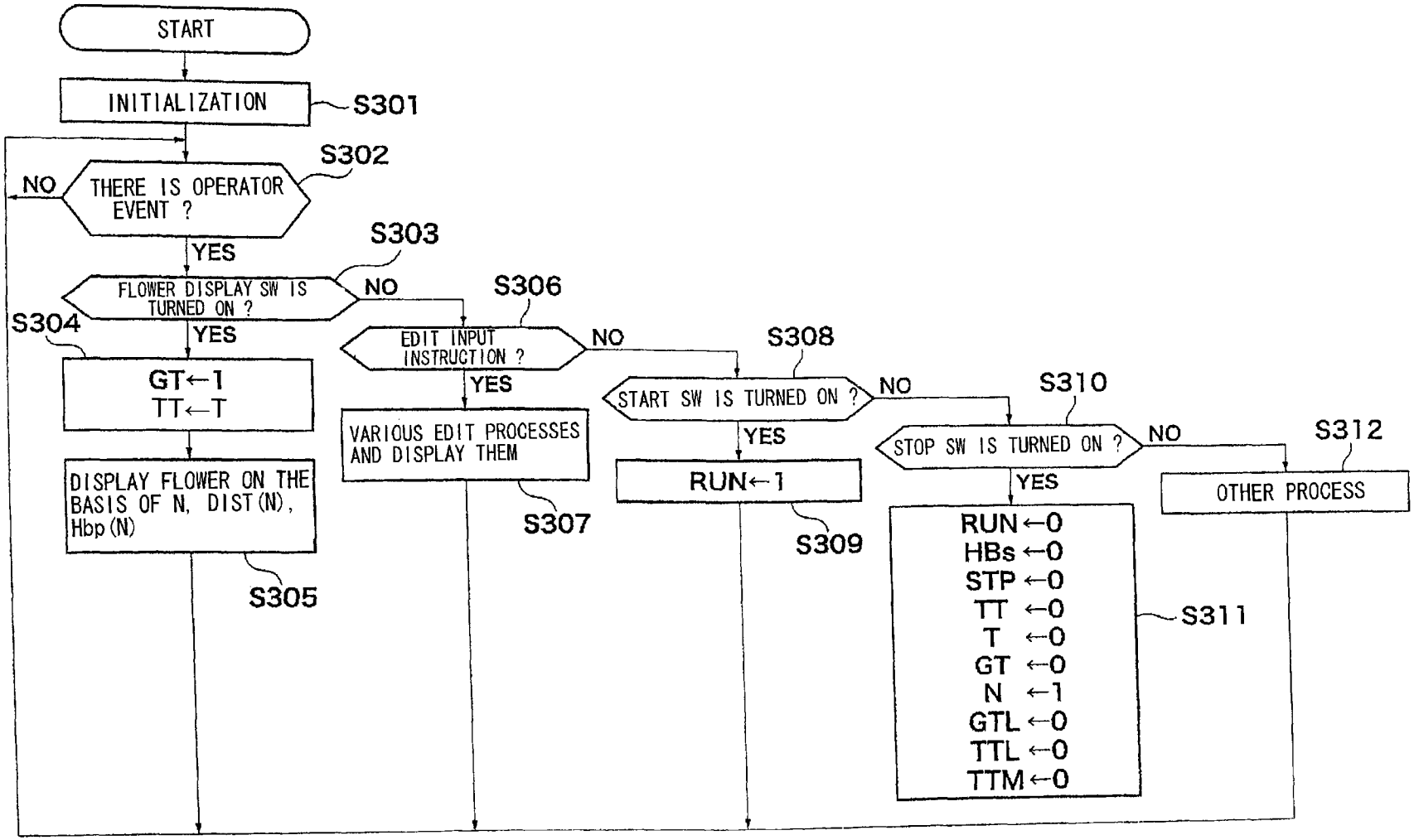
FIG. 15 is a flowchart of a main process executed by the wearable apparatus.

A "flag GT" indicates that a display process of the exercise condition flower display 30 is being executed as "1", and is reset to "0" after three seconds (Step S304 of FIG. 15 and Step S608 of FIG. 17).

A "register value TT" indicates time when a flower display instruction is made, and is reset to "0" after three seconds (Step S304 of FIG. 15 and Step S608 of FIG. 17).

Figure 16A:
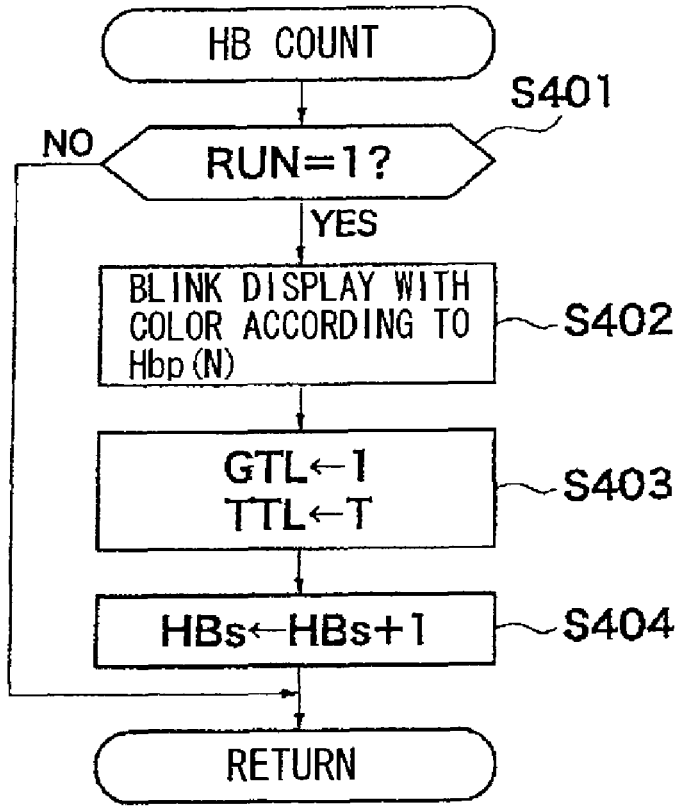
FIG. 16A is a flowchart of an HB counting process.

A "flag GTL" indicates that blink display is being executed as "1", and is reset to "0" after 0.2 seconds (Step S403 of FIG. 16A and Step S604 of FIG. 17).

A "register value TTL" indicates time when blink display is started, and is reset after 0.2 seconds (Step S403 of FIG. 16A and Step S604 of FIG. 17).

A "register value TTM" indicates time when update of the heart rate HB(N) or the like, or an operation of the Hbp(N) value, the walking distance DIST(N) or the like is executed. The time is set to the "register value TTM" every one minute (Steps S613 and S614 of FIG. 17).

Further, a "counter value N" is similar to that in the first embodiment. The counter value N is set to "1" at Step S311 of FIG. 15, and is counted up whenever a process at Step S613 of FIG. 17 is executed. A "heart rate HB(N)", a "Hbp(N) value" and a "walking distance DIST(N)" are similar to those in the first embodiment. They are updated and calculated at Steps S611 and S612 of FIG. 17.

FIG. 15 is a flowchart of a main process that may be executed by the wearable apparatus 100.

Initialization of various flags and register values is first executed (Step S301). It is determined whether there is an operator event or not (Step S302). In the case where it is determined that there is an operator event, it is determined whether or not any button of the group of switches 128 (see FIG. 13) is operated (Steps S303, S306, S308 and S310). In the case where it is determined that one button is operated, a process according to the operated switch is executed.

Namely, in the case where the edit SW 128*a* is turned on and an edit input is thereby instructed, various edit processes and display processes according to the instruction are executed in the same manner as that at Step S107 of FIG. 6 (Steps S306 and S307). Input of personal basic information is also made at this step. Then, the processing flow returns to Step S302. Alternatively, in the case where the start SW 128*b* is turned on, the flag RUN is set to "1" (Steps S308 and S309), and the processing flow returns to Step S302.

Further, in the case where the stop SW 128*c* is turned on, each of the flag RUN, the register value HBs, the register value STP, the register value TT, the timer T, the flag GT, the flag GTL, the register value TTL and the register value TTM is set to "0", and the counter value N is set to "1" (Steps S310 and S311). Then, the processing flow returns to Step S302. In the case where other switch than the SWs 128*a* to 128*d* is turned on, other process according to the other switch is executed (Steps S310 and S312), the processing flow returns to Step S302.

Moreover, in the case where the flower display SW 128*d* is turned on (Step S303), the flag GT is set to "1" and a current value of the timer T is set to the register value TT (Step S304). Then, on the basis of the N value, the DIST(N) value and the Hbp(N) value, the display device 125 is caused to display the exercise condition flower display 30 (Step S305). Here, in addition to radial display arrangement lines 31, all of the color ball images 32 corresponding to each time at one-minute intervals until the current time point are displayed (see FIG. 14). The display example of FIG. 14 corresponds to the daily display in the case where the fitness exercise is terminated at the time when four minutes elapses in the first embodiment.

FIG. 16A is a flowchart of an HB counting process. The present process is executed whenever a signal from the heart rate sensor 14 comes in.

In the present process, only when RUN=1 is met (Step S401), the LED 61 (see FIG. 14) is started to turn on with a color according to the Hbp(N) value (Step S402). The flag GTL is set to "1", and the current value of the timer T is set to the register value TTL (Step S403). Then, the register value HBs is caused to increment (Step S404), and the processing flow is terminated. According to the present process, luminescence of the LED 61 with the color according to the Hbp(N) value is started in synchronization with the heart beat of the exerciser 1, and the heart rate is integrated.

Here, the luminous color of the LED 61 is determined using the table similar to the Hbp-color converting table (see FIG. 4B) in the first embodiment. This table is stored in the ROM 126.

Figure 16B:
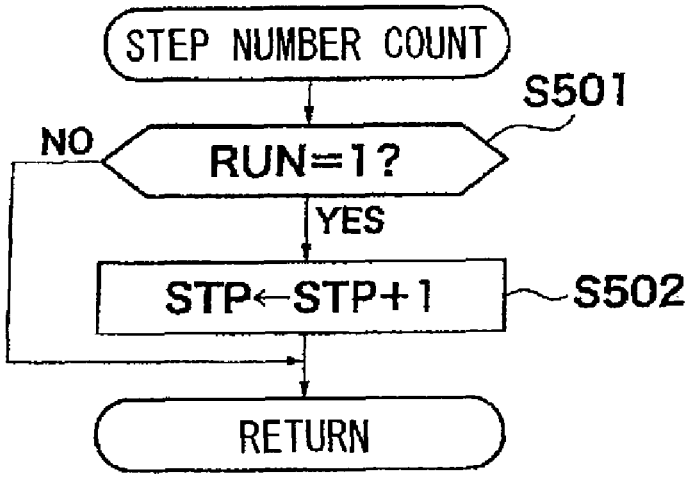
FIG. 16B is a flowchart of a step number counting process.

FIG. 16B is a flowchart of a step number counting process. The present process is executed whenever a walking action is detected in the acceleration sensor 11 and a signal from the acceleration sensor 11 is outputted.

In the present process, only when RUN=1 is met (Step S501), the register value STP is caused to increment whenever a signal is outputted from the acceleration sensor 11 (Step S502).

FIG. 17 is a flowchart of a timer process that is executed at fixed time intervals during execution of the main process of FIG. 15. The present process is started every 10 msec., for example, and as a result, it is executed with a frequency of 100 times/sec.

As shown in FIG. 17, only in the case where the formula "RUN=1" is met (Step S601), a blink display turning-off process (Steps S602 to S605), a flower display eliminating process (Steps S606 to S609), and a various operations and value updating process for every one minute (Steps S610 to S613) is executed.

First, only in the case where GTL=1 is met at Step S602, it is determined whether T=TTL+about 0.2 seconds is met or not (Step S603). Here, the "about 0.2 seconds" corresponds to (100 times/sec.)×0.2=20 counts. When a process at Step S614 of FIG. 17 is repeatedly executed 20 times after the value of the timer T is set to the register value TTL at Step S403 of FIG. 16A, T=TTL+about 0.2 seconds is met. Then, only in the case where the above formula is met, the flag GTL is set to "0", and the register value TTL is reset (Step S604). The blink display is thereby terminated, that is, the LED 61 that is tuned on is turned off (Step S605). Thus, the blink display continues only for 0.2 seconds in synchronization with the heart beat.

Next, only in the case where GT=1 is met at Step S606, it is determined whether T=TT+about 3 seconds is met or not (Step S607). Here, the "about 3 seconds" corresponds to 300 counts. When the process at Step S614 of FIG. 17 is repeatedly executed 30 times after the value of the timer T is set to the register value TT at Step S304 of FIG. 15, T=TT+about 3 seconds is met.

Then, only in the case where the above formula is met, the flag GT is set to "0", and the register value TT is reset (Step S608). The displayed exercise condition flower display 30 is eliminated (Step S609). Thus, the display of the exercise condition flower display 30 continues only for three seconds after the flower display SW 128*d* is turned on.

Next, at Step S610, it is determined whether T=TTM+about one minute is met or not. Here, the "about one minute" corresponds to 6,000 counts. When the process at Step S614 is repeatedly executed 6,000 times after the value of the timer T is set to the register value TTM at Step S613 (will be described later), T=TTM+about one minute is met.

Then, only in the case where the above formula is met, the value of the register value HBs is set to the heart rate HB(N), and the value of the register value STP is set to the step number STP_min(N) (Step S611). Next, at Step S612, data processing similar to the process at Step S204 of FIG. 7 is executed to calculate the walking distance DIST(N) and the Hbp(N) value using the Formulas 1 and 2 described above. Next, each of the register value STP and the register value HBs is reset to "0", the current value of the timer T is set to the register value TTM, and the counter value N is caused to increment (Step S613).

Next, the timer T is counted up (Step S614), and the processing flow is then terminated.

According to the present embodiment, the LED 61 is blink displayed in synchronization with the heart beat, and the luminous color at that time is set to a color according to the Hbp(N) value. The Hbp(N) value indicates the load on the exerciser 1 grasped for the latest one minute (the predetermined time period). Thus, by varying the display color in accordance with the load on the exerciser 1, it is possible to cause the exerciser 1 to quickly grasp the latest load condition by the fitness exercise using intuitive display. In addition, by causing the LED 61 to be turned on in synchronization with the heart beat, the exerciser 1 is allowed to grasp the current load with the interval of blinking and the color.

Further, when the flower display SW 128*d* is pressed, the exercise condition flower display 30 is displayed on the basis of the data until the present time point. Thus, the color of the color ball image 32 of the latest time allows the exerciser 1 to grasp the current load. In addition, a change in the color of the color ball image 32 at each time and a change in the size thereof allow the exerciser 1 to intuitively and quickly grasp transition of the load and transition of the amount of digested exercise, respectively.

Moreover, the LED 61 is automatically tuned on and off, and the exercise condition flower display 30 is automatically eliminated after three seconds from a display instruction operation. Thus, there is no need for a cancel operation, and it is thereby convenient for the exerciser 1 who continues to exercise.

Fourth Embodiment

In the third embodiment, the display color of the LED 61 is set to the color according to the Hbp(N) value, and is updated every one minute. On the other hand, in a fourth embodiment of the present invention, the LED 61 is caused to emit light with a color according to the load grasped for latest 10 seconds (the predetermined time period). Thus, although a basic configuration of the fourth embodiment is similar to that of the third embodiment, an HB counting process and a timer process is different from each other. Other configuration is the same as that in third embodiment.

Figure 18A:
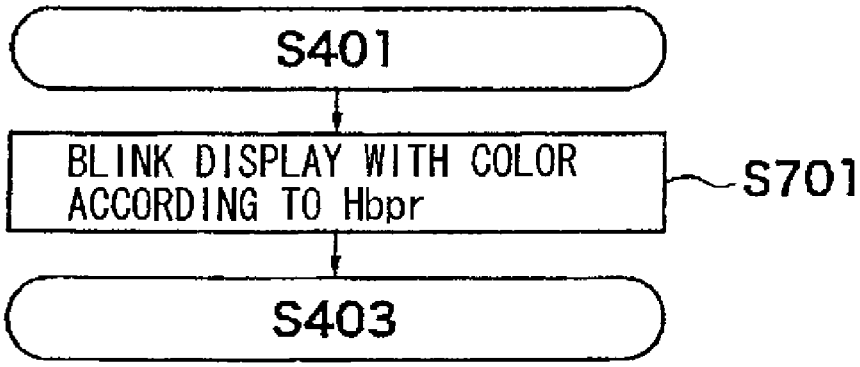
FIG. 18A is a flowchart of an HB counting process according to a fourth embodiment of the present invention.

FIG. 18A is a flowchart of an HB counting process according to the fourth embodiment of the present invention. The present flowchart is a flowchart in which Step S701 is inserted between Steps S401 and S403 of FIG. 16. Namely, Step S701 is inserted therebetween in place of Step S402. At Step S701, the LED 61 (see FIG. 14) is started to turn on with a color according to the percentage of heart rate reserve Hbpr calculated at Step S804 of FIG. 18B (will be described later), and the processing flow proceeds to Step S403 and later.

Figure 18B:
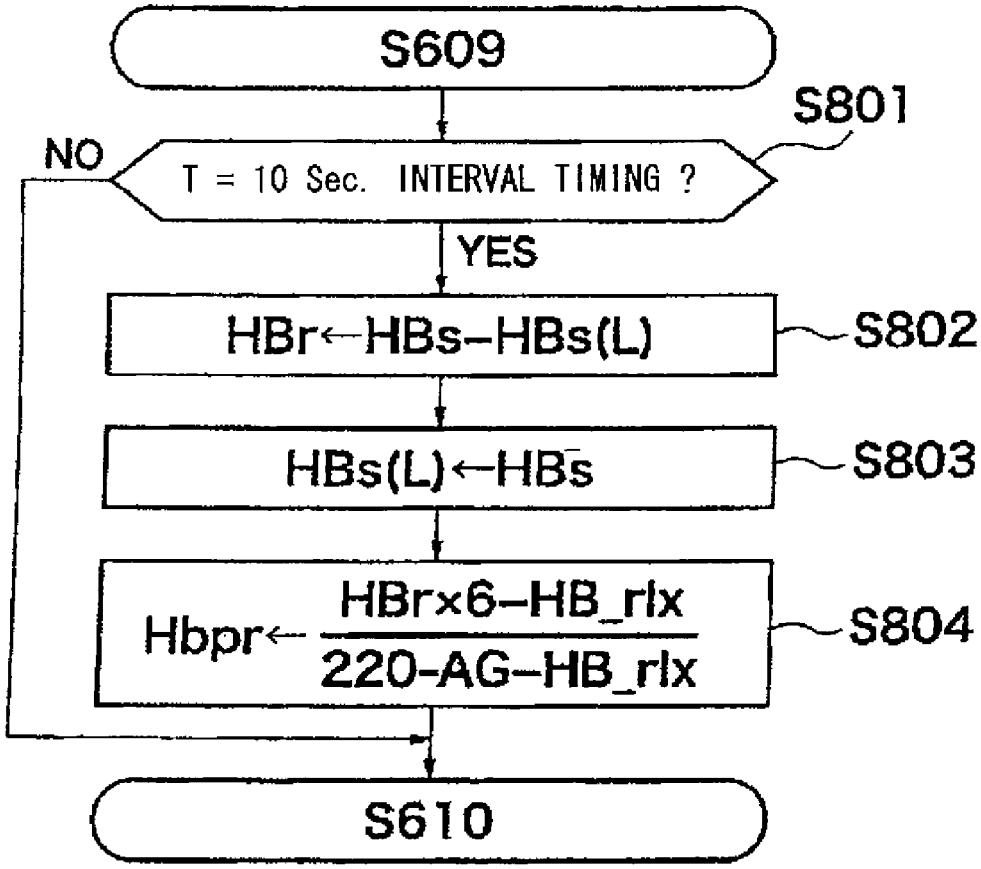
FIG. 18B is a flowchart of a timer process according to the fourth embodiment of the present invention.

FIG. 18B is a flowchart of a timer process that is executed at fixed time intervals during execution of the main process of FIG. 15 in the fourth embodiment. The present flowchart is a flowchart in which "various operations and value updating process for every 10 seconds" at Steps S801 to S804 are inserted between Steps S609 and S610 of FIG. 17.

Namely, at Step S801, it is determined whether or not the timer T becomes timing that comes at 10-second intervals. This condition is met whenever the timer T becomes the count number of integral multiplication of 1,000. Then, only in the case where the condition is met, a difference value between the value of the latest register value HBs and the value of the previous register value HBs (L) is set to the present register value HBr (Step S802). Next, the value of the present register value HBs is set to the previous register value HBs (L) (Step S803).

Next, the Hbpr value is calculated using the following formula 3 (Step S804), and the processing flow proceeds to Step S610 and later described above.

$$Hbpr[\%]=\{HBr\times 6-HB_rlx\}\times 100/\{220-AG-HB_rlx\} \quad \text{[Formula 3]}$$

Thus, the Hbpr value is updated at 10-second intervals, and the LED 61 emits light with a color according to the latest Hbpr value at Step S701 of FIG. 18A. The term "HBr×6" corresponds to a value obtained by converting the heart rate detected for 10 seconds to the heart rate for one minute.

According to the present embodiment, not only the effect similar to that in the third embodiment is achieved, but also the luminous color of the LED 61 is determined in accordance with the load grasped for latest 10 seconds that is shorter than one minute. Thus, the exerciser 1 is allowed to grasp the latest load condition in near real time. In addition, the color of the color ball image 32 corresponding to the latest time in the exercise condition flower display 30 indicates the load on the exerciser 1 for the latest one minute, and the luminous color of the LED 61 indicates the load on the exerciser 1 for latest 10 seconds. Thus, the exerciser 1 is allowed to quickly grasp the latest load condition and the change in the load by means of the display at two kinds of most recent time.

In this regard, in the third and fourth embodiments, the display arrangement lines 31 in the exercise condition flower display 30 may not also be displayed actually.

In this regard, in the third and fourth embodiments, all of the color ball images 32 are displayed in the exercise condition flower display 30, but only the color ball image 32 corresponding to the latest time may be displayed.

In this regard, in the third and fourth embodiments, the wearable apparatus 100 is caused to have a display control function similar to the fitness managing apparatus 20, and in the same manner as that in the first embodiment, the display device 125 may be allowed to do daily, monthly, or weekly display of the exercise condition flower display 30 after termination of the fitness exercise.

In this regard, in each of the embodiments described above, the color of each of the color ball images 32 is varied in accordance with the Hbp(N) value and the like, but the concept of this "color" includes elements of a color phase (hue), brightness and chroma, and the color is defined by a combination of them. Thus, a change in the color can be applied using only so-called one color, and for example, a change in shading of black and white is provided in accordance with the Hbp(N) value or the like. Further, this can be applied to the luminous color of the LED 61 in the third and fourth embodiments. Moreover, the change in the color is not limited to a stepless control, and the color may be changed with a plurality of steps.

In this regard, in each of the embodiments described above, the time interval to divide the fitness exercise duration time for data acquirement is to be one minute, but it is not limited thereto. In addition, the time (0.2 seconds) of the blink display in the third and fourth embodiments (Step S603 of FIG. 17) is not also limited to this time. Moreover, the time interval to update the Hbpr value in the fourth embodiment (Step S801 of FIG. 18B) is not also limited to 10 seconds.

In this regard, since each of the embodiments described above is illustrative of walking fitness exercise using a treadmill as the fitness exercise, the step number STP_min that indicates the number of steps is to be measured as data indicating the amount of digested exercise (walking distance DIST). However, since the amount of digested exercise may be seen or obtained, one to be measured is not limited to the number of steps. It may be changed depending on fitness exercise. For example, in the case of a cycling machine, the rotation number of a wheel or the like may be utilized. In the case of repetition fitness exercise such as bending and stretching, the number of times of repetition may be utilized. As shown in FIG. 1, since the wearable apparatus 10 can be applied to an arm of the exerciser 1, the wearable apparatus 10 is suitable of walking, jogging, running and the like out of doors.

Further, the heart rate HB(N) is measured as data for calculating hardness of fitness exercise (Hbp value). However, since a load on the exerciser 1 may be seen or obtained, one to be measured is not limited thereto. For example, the amount of carbon dioxide in breathing gas of the exerciser 1 may be measured using a breathing gas analyzer or the like, and hardness of fitness exercise (load) corresponding to the Hbp value may be calculated on the basis of the amount of measured carbon dioxide.

In this regard, in the first embodiment, a control method of displaying the exercise condition flower display 30 as explained using FIGS. 9A to 9C can be applied to the third and fourth embodiments. Further, the alternative example of the exercise condition flower display 30 shown in FIGS. 10A, 10B and FIGS. 12A-12D can be applied to the third and fourth embodiment.

In this regard, in each of the embodiments described above, a combined operation of one switch and another switch may be configured to accomplish a different function.

Further, the object of the present invention can be achieved by executing the following processes. Namely, the processes includes a process that a storage medium for storing program codes of software for achieving the functions of the embodiment described above is supplied to a system or an apparatus, and a process that a computer (or CPU, MPU or the like) of the system or the apparatus reads out the program codes stored in the storage medium.

In this case, the program codes themselves read out from the storage medium achieves the functions of the embodiments described above, and the program codes and the storage medium in which the program codes are stored constitute the present invention.

Further, as the storage medium for supplying the program codes, the following ones can be used. For example, a Floppy® disk, a hard disk drive, a magneto-optical disc, a CD-ROM, a CD-R, a CD-RW, a DVD-ROM, a DVD-RAM, a DVD-RW, a DVD+RW, a magnetic tape, a nonvolatile memory card, a ROM and the like may be mentioned. Alternatively, the program codes may be downloaded via a network.

Further, the case where the functions of the embodiments described above are realized by executing the program codes that the computer reads out is included in the present invention. In addition, the case where an OS (operating system) or the like that runs on the computer executes a part or all of the actual processes in response to instructions of the program codes, whereby the functions of the embodiments described above are realized by the processes is also included in the present invention.

Moreover, the case where the functions of the embodiments described above are realized by the following processes is also included in the present invention. Namely, in such a case, the program codes read out from the storage medium are written in a memory provided in a functionality expansion board inserted in the computer or a functionality expansion unit connected to the computer. Then, a CPU or the like provided in the functionality expansion board or the functionality expansion unit executes a part or all of the actual processes in response to instructions of the program codes.

The present invention can be constructed and implemented, not only as the apparatus and system as discussed above, but also as a method. Also, the present invention can be implemented as a software program in a computer-readable medium. Further, a dedicated processor with dedicated logic built in hardware, not to mention a computer or other general-purpose type processor capable of running a desired software program, can be used to carry out the present invention.

While the present invention has been particularly shown and described with reference to preferred embodiment thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priority to, Japanese Patent Application No. 2007-003843 filed on Jan. 11, 2007 and No. 2007-003842 filed on Jan. 11, 2007. The disclosure of the priority application, in its entirety, including the drawings, claims, and the specification thereof, is incorporated herein by reference.

What is claimed is:

1. An apparatus for displaying a fitness exercise condition, the apparatus comprising:

a basic information inputting section that inputs personal basic information on an exerciser;

a heart rate data acquiring section that acquires data on a heart rate measured during a fitness exercise;

a load calculating section that calculates load data indicating hardness of the fitness exercise on the basis of the personal basic information input by the basic information inputting section and the data on the heart rate acquired by the heart rate data acquiring section;

a display section; and a display controlling section that causes the display section to display a notice comprising a plurality of color areas each representing a predetermined time interval with a color according to a load on the exerciser for each of the predetermined time intervals on the basis of the load data calculated by the load calculating section, wherein each of the color areas representing the predetermined time intervals that have elapsed remains visible after the respective predetermine time interval has elapsed.

2. The apparatus as claimed in claim 1, wherein the display controlling section causes the display section to display the notice in synchronization with the heart rate.

3. The apparatus as claimed in claim 1, wherein:

the notice further comprises a plurality of lines each corresponding to one of the predetermined time intervals, each of the color areas is located at one end or adjacent to the one end of one of the lines, and changes in at least one of a color or a size according to the load on the exerciser, and each of the color areas corresponding to the predetermined time interval that has elapsed remains visible after the respective predetermined time interval has elapsed.

4. The apparatus as claimed in claim 3, wherein a plurality of lines extend radially from a common central portion.

5. The apparatus as claimed in claim 3, wherein the plurality of lines are parallel to each other.

6. The apparatus as claimed in claim 3, wherein the color area is at one end of each of the lines and changes both in color and size.

7. The apparatus as claimed in claim 3, wherein each of the ends of the lines has a size area that changes in size and the color area corresponding thereto is adjacent to the respective size area.

8. The apparatus as claimed in claim 1, wherein:

the display section includes a first display and a second display, and the display control section causes the first display to display the notice corresponding to each of the time intervals, with a color corresponding to the load data calculated for the time interval and causes the second display to display the notice with the color corresponding to the load of the last previous predetermined time interval.

9. The apparatus as claimed in claim 1, wherein the display control section further causes the display section to display the notice on a date-by-date basis.

10. An apparatus for displaying a fitness exercise condition, the apparatus comprising:

a basic information inputting section that inputs personal basic information on an exerciser;

a heart rate data acquiring section that acquires data on a heart rate measured during a fitness exercise;

a load calculating section that calculates load data indicating hardness of the fitness exercise on the basis of the personal basic information input by the basic information inputting section and the data on the heart rate acquired by the heart rate data acquiring section;

a display section;

a display controlling section that causes the display section to display notice with a color according to a load on the exerciser for each of predetermined time intervals on the basis of the load data calculated by the load calculating section;

a start switch that instructs measurement to start;

a display instructing switch; and a display position determining section that determines a display position of the notice corresponding to each of the predetermined time intervals included between a first time point when the start switch is turned on and a second time point when the display instructing switch is turned on, wherein the display controlling section causes the display section to display the notice corresponding to each of the predetermined time intervals at the position determined by the display position determining section.

11. The apparatus as claimed in claim 10, further comprising:

a digestion amount data acquiring section that acquires exercise digestion amount data indicating an amount of digested exercise during the fitness exercise, wherein the display controlling section causes the display section to change a size of the notice corresponding to each of the predetermined time intervals to be displayed in accordance with the exercise digestion amount data acquired for each of the predetermined time intervals by the digestion amount data acquiring section.

12. An apparatus for displaying a fitness exercise condition, the apparatus comprising:

a basic information inputting section that inputs personal basic information on an exerciser;

a heart rate data acquiring section that acquires data on a heart rate measured during a fitness exercise;

a load calculating section that calculates load data indicating hardness of the fitness exercise on the basis of the personal basic information input by the basic information inputting section and the data on the heart rate acquired by the heart rate data acquiring section;

a display section;

a display controlling section that causes the display section to display notice with a color according to a load on the exerciser for each of predetermined time intervals on the basis of the load data calculated by the load calculating section, wherein the display section includes first and second display sub sections, and wherein the display controlling section causes the first sub display section to display first notice with a first color corresponding to load data for a first predetermined time interval calculated by the load calculating section, and causes the second sub display section to display second notice with a second color corresponding to load data for a second predetermined time interval that is shorter than the first predetermined time interval.

13. An apparatus for displaying a fitness exercise condition, the apparatus comprising:

a basic information inputting section that inputs personal basic information on an exerciser;

a heart rate data acquiring section that acquires data on a heart rate measured during a fitness exercise;

a load calculating section that calculates load data indicating hardness of the fitness exercise on the basis of the personal basic information input by the basic information inputting section and the data on the heart rate acquired by the heart rate data acquiring section;

a display section;

a display controlling section that causes the display section to display notice with a color according to a load on the exerciser for each of predetermined time intervals on the basis of the load data calculated by the load calculating section, wherein the display controlling section causes the display section to display the notice with a warmer color as a load condition on the exerciser becomes heavier, and wherein the display controlling section causes the display section to display the notice with green when the load condition on the exerciser is suitable, and causes the display section to display the notice with blue when the load condition on the exerciser is light.

14. An apparatus to be attachable to a wrist or arm of an exerciser for displaying a fitness exercise condition, the apparatus displaying a load condition of fitness exercise on the basis of load data indicating hardness of the fitness exercise and exercise digestion amount data indicating an amount of digested exercise, the load data and the exercise digestion amount data being measured at predetermined time intervals during the fitness exercise, the apparatus comprising:

a display section for displaying at least notice, comprising a plurality of color areas each representing a predetermined time interval, indicating a fitness exercise load condition with a color for each of the predetermined time intervals;

a display controlling section that determines a color for each predetermined time interval to be displayed on one of the color areas on the basis of the load data measured at the predetermined time intervals, and causes the display section to display the notice with the determined color, wherein each of the color areas representing the predetermined time intervals that have elapsed remains visible after the respective predetermine time interval has elapsed.

15. The apparatus as claimed in claim 14, further comprising:

a body case, and a case holder that holds the body base, wherein the case holder includes a holding member adapted to be worn on the wrist or arm of the exerciser.

16. An apparatus for displaying a fitness exercise condition on the basis of load data indicating hardness of fitness exercise and exercise digestion amount data indicating an amount of digested exercise, the load data and the exercise digestion amount data being measured at predetermined time intervals during the fitness exercise, the apparatus comprising:

a display section;

a display position determining section that determines a display position of an image to be displayed on the display section in correspondence with each of the predetermined time intervals, the image having a predetermined shape;

a size determining section that determines a size of the image corresponding to each of the predetermined time intervals on the basis of the exercise digestion amount data measured at the predetermined time intervals;

a color determining section that determines a color of the image corresponding to each of the predetermined time intervals on the basis of the load data measured at the predetermined time intervals; and a display controlling section that causes the display section to display the image corresponding to each of the predetermined time intervals at the display position determined by the display position determining section, the image having the size determined by the size determining section and the color determined by the color determining section.

17. The apparatus as claimed in claim 16, wherein:

the load data and the exercise digestion amount data are measured at every lesson when the fitness exercise is carried out, the apparatus further comprises:

a lesson specifying section that specifies a lesson of fitness exercise to be displayed from multiple lessons of fitness exercise; and a display area setting section that sets a display area of the lesson of the fitness exercise specified by the lesson specifying section on the display section in correspondence with each of the multiple lessons, and the display controlling section causes the display section to display all of the images corresponding to the specified lesson of the fitness exercise at the respective display areas set by the display area setting section.

18. An apparatus for displaying a fitness exercise condition on the basis of load data indicating hardness of fitness exercise and exercise digestion amount data indicating an amount of digested exercise, the load data and the exercise digestion amount data being measured at predetermined time intervals during the fitness exercise, the apparatus comprising:

a display section;

a display arrangement line determining section that determines each of display arrangement lines when an image is to be displayed on the display section in accordance with each of the predetermined time intervals, the image having a predetermined shape corresponding to each of the predetermined time intervals;

an on-line position determining section that determines a display position of the image corresponding to each of the predetermined time intervals on the corresponding display arrangement line on the basis of the exercise digestion amount data measured at each of the predetermined time intervals;

a size/color determining section that determines at least one of a size and a color of the image corresponding to each of the predetermined time intervals on the basis of the load data measured at each of the predetermined time intervals; and a display controlling section that causes the display section to display the image corresponding to each of the predetermined time intervals at the display position determined by the on-line position determining section on the display arrangement line determined by the display arrangement line determining section, the image having at least one of the size and the color determined by the size/color determining section.

19. The apparatus as claimed in claim 18, wherein:

the load data and the exercise digestion amount data are measured at every lesson when the fitness exercise is carried out, the apparatus further comprises:

a lesson specifying section that specifies a lesson of fitness exercise to be displayed from multiple lessons of fitness exercise; and a display area setting section that sets a display area of the lesson of the fitness exercise specified by the lesson specifying section on the display section in correspondence with each of the multiple lessons, and the display controlling section causes the display section to display all of the images corresponding to the specified lesson of the fitness exercise at the respective display areas set by the display area setting section.

20. A computer program product comprising non-transitory computer-readable storage medium storing a computer program for displaying a fitness exercise condition on a display device on the basis of load data indicating hardness of fitness exercise and exercise digestion amount data indicating an amount of digested exercise, the load data and the exercise digestion amount data being measured at predetermined time intervals during the fitness exercise, the computer program being executable by a computer to:

determine a display position of an image to be displayed on the display device in correspondence with each of the predetermined time intervals, the image having a predetermined shape;

determine a size of the image corresponding to each of the predetermined time intervals on the basis of the exercise digestion amount data measured at the predetermined time intervals;

determine a color of the image corresponding to each of the time intervals on the basis of the load data measured at the predetermined time intervals; and cause the display device to display the image corresponding to each of the predetermined time intervals at the determined display position, the image having the determined size and the determined color.

21. A computer program product comprising a non-transitory computer-readable storage medium storing a computer program for displaying a fitness exercise condition on a display device on the basis of load data indicating hardness of fitness exercise and exercise digestion amount data indicating an amount of digested exercise, the load data and the exercise digestion amount data being measured at predetermined time intervals during the fitness exercise, the computer program being executable by a computer to:

determine each of display arrangement lines when an image is to be displayed on the display device in accordance with each of the predetermined time intervals, the image having a predetermined shape corresponding to each of the predetermined time intervals;

determine a display position of the image corresponding to each of the predetermined time intervals on the corresponding display arrangement line on the basis of the exercise digestion amount data measured at each of the predetermined time intervals;

determined at least one of a size and a color of the image corresponding to each of the predetermined time intervals on the basis of the load data measured at each of the predetermined time intervals; and cause the display device to display the image corresponding to each of the predetermined time intervals at the determined display position on the determined display arrangement line, the image having at least one of the determined size and the determined color.

22. An apparatus for displaying a fitness exercise condition, the apparatus comprising:

a load calculating section that calculates load data indicating hardness of the fitness exercise;

a display section;

a display controlling section that causes the display section to display a notice corresponding to a load on the exerciser for each of predetermined time intervals on the basis of the load data calculated by the load calculating section; and a digestion amount data acquiring section that acquires exercise digestion amount data indicating an amount of digested exercise during the fitness exercise, wherein the display controlling section causes the display section to change a size of the notice corresponding to each of the predetermined time intervals to be displayed in accordance with the exercise digestion amount data acquired for each of the predetermined time intervals by the digestion amount data acquiring section.

* * * * *